US011890521B1

(12) United States Patent
Campbell et al.

(10) Patent No.: US 11,890,521 B1
(45) Date of Patent: Feb. 6, 2024

(54) BASKETBALL TRAINING SYSTEM

(71) Applicant: Airborne Athletics, Inc., Bloomington, MN (US)

(72) Inventors: Douglas B. Campbell, Loretto, MN (US); Jeffrey J. Campbell, Lonsdale, MN (US); Adam T. Pan, Bloomington, MN (US)

(73) Assignee: Airborne Athletics, Inc., Bloomington, MN (US)

( * ) Notice: Subject to any disclaimer, the term of this patent is extended or adjusted under 35 U.S.C. 154(b) by 0 days.

(21) Appl. No.: 18/126,647

(22) Filed: Mar. 27, 2023

Related U.S. Application Data

(63) Continuation of application No. 16/811,902, filed on Mar. 6, 2020, now Pat. No. 11,247,109, which is a continuation of application No. 15/805,919, filed on Nov. 7, 2017, now Pat. No. 10,596,436.

(60) Provisional application No. 62/419,177, filed on Nov. 8, 2016.

(51) Int. Cl.

| | |
|---|---|
| ***A63B 69/00*** | (2006.01) |
| ***A63B 71/02*** | (2006.01) |
| ***A63B 63/00*** | (2006.01) |
| ***A63B 63/08*** | (2006.01) |
| ***A63B 24/00*** | (2006.01) |

(52) U.S. Cl.
CPC ..... *A63B 69/0071* (2013.01); *A63B 71/02* (2013.01); *A63B 24/0021* (2013.01); *A63B 24/0075* (2013.01); *A63B 63/00* (2013.01); *A63B 63/083* (2013.01); *A63B 2225/02* (2013.01)

(58) Field of Classification Search
CPC . A63B 69/0071; A63B 71/02; A63B 24/0021; A63B 24/0075; A63B 63/00; A63B 63/083; A63B 2225/02
See application file for complete search history.

(56) References Cited

U.S. PATENT DOCUMENTS

| | | | |
|---|---|---|---|
| 1,223,386 | A | 4/1917 | Handelan |
| 2,908,266 | A | 10/1959 | Cooper |
| 3,776,550 | A | 12/1973 | McNabb |
| 3,802,703 | A | 4/1974 | Van Tassel |
| 3,878,828 | A | 4/1975 | Francesco |
| 4,168,695 | A | 9/1979 | Haller et al. |

(Continued)

FOREIGN PATENT DOCUMENTS

WO WO 1995032033 11/1995

OTHER PUBLICATIONS

Airborne Athletics, Inc. 1 page advertising brochure, © Airborne Athletics, Inc., before 2012, 1 page.

(Continued)

*Primary Examiner* — Jeffrey S Vanderveen
(74) *Attorney, Agent, or Firm* — Fish & Richardson P.C.

(57) ABSTRACT

A basketball training system includes a server computer and a basketball training machine. The server computer executes a workout module that manages operation of a graphical user interface that presents a graphical representation of a portion of a basketball court and receives user inputs that define a workout program that includes selected ball delivery locations relative to the visual representation. The basketball training machine receives the workout program and delivers basketballs to the selected ball delivery locations.

15 Claims, 26 Drawing Sheets

(56) References Cited

U.S. PATENT DOCUMENTS 4,262,648 A 4/1981 Wegener et al.
4,471,746 A 9/1984 Ando
4,517,953 A 5/1985 Osaka et al.
4,579,340 A 4/1986 Jenkins et al.
4,667,957 A 5/1987 Joseph
4,678,189 A 7/1987 Koss
4,714,248 A 12/1987 Koss
4,882,676 A 11/1989 Van De Kop et al.
4,913,431 A 4/1990 Jakobs
4,915,384 A 4/1990 Bear
4,915,387 A 4/1990 Baxstrom
4,936,577 A 6/1990 Kington et al.
4,940,231 A 7/1990 Ehler
4,955,605 A 9/1990 Goldfarb
5,016,875 A 5/1991 Joseph
5,125,651 A 6/1992 Keeling et al.
5,183,253 A 2/1993 Grimaldi et al.
5,312,099 A 5/1994 Oliver, Sr.
5,365,427 A 11/1994 Soignet et al.
5,393,049 A 2/1995 Nelson
5,409,211 A 4/1995 Adamek
5,417,196 A 5/1995 Morrison et al.
5,464,208 A 11/1995 Pierce
5,540,428 A 7/1996 Joseph
5,601,284 A 2/1997 Blackwell et al.
5,676,120 A 10/1997 Joseph
5,681,230 A 10/1997 Krings
5,692,978 A 12/1997 Hummel
5,746,668 A 5/1998 Ochs
5,771,018 A 6/1998 Kennedy
5,776,018 A 7/1998 Simpson et al.
5,813,926 A 9/1998 Vance
5,816,953 A 10/1998 Cleveland
5,842,699 A 12/1998 Mirando et al.
5,929,851 A 7/1999 Donnelly
5,937,143 A 8/1999 Watanabe et al.
5,980,399 A 11/1999 Campbell et al.
6,167,328 A 12/2000 Takaoka et al.
6,224,503 B1 5/2001 Joseph
6,241,628 B1 6/2001 Jenkins et al.
6,280,352 B1 8/2001 Coffeen et al.
6,302,811 B1 10/2001 Topham
6,389,368 B1 5/2002 Hampton
6,390,940 B1 5/2002 Naulls et al.
6,458,049 B2 10/2002 Bush
6,546,924 B2 4/2003 Battersby et al.
6,659,893 B1 12/2003 Campbell et al.
6,707,487 B1 3/2004 Aman et al.
6,918,591 B2 7/2005 D'amico et al.
7,056,237 B2 6/2006 Slavey et al.
7,066,845 B2 6/2006 Joseph
7,082,938 B2 8/2006 Wilmot
7,288,034 B2 10/2007 Woodard et al.
7,620,466 B2 11/2009 Neale et al.
7,641,574 B2 1/2010 Steen
7,766,770 B2 8/2010 Cucjen et al.
7,927,237 B2 4/2011 Jenkins et al.
7,942,784 B1 5/2011 Hyde et al.
7,945,349 B2 5/2011 Svensson et al.
7,970,492 B2 6/2011 Matsushima
8,012,046 B2 9/2011 Campbell et al.
8,123,634 B1 2/2012 Lovett
8,147,356 B2 4/2012 Campbell et al.
8,206,246 B2 6/2012 Joseph et al.
8,301,277 B2 10/2012 Jones
8,617,008 B2 12/2013 Marty et al.
8,727,784 B1 5/2014 Wolf
8,845,460 B1 9/2014 Feldstein
8,852,030 B2 10/2014 Campbell et al.
8,911,308 B2 12/2014 Daniels
9,017,188 B2 4/2015 Joseph et al.
D739,488 S 9/2015 Campbell et al.
9,199,150 B2 12/2015 Wackerly
9,444,306 B2 9/2016 Bradfield
9,452,339 B1 9/2016 Shah et al.
9,569,005 B2 2/2017 Ahmed et al.
9,600,716 B2 3/2017 Skjaerseth et al.
9,656,140 B2 5/2017 Thurman et al.
9,724,584 B1 8/2017 Campbell et al.
9,808,696 B2 11/2017 Campbell et al.
9,901,801 B2 2/2018 Thurman et al.
9,914,035 B2 3/2018 Campbell et al.
9,975,026 B2 5/2018 Campbell et al.
10,004,949 B2 6/2018 Brothers et al.
10,192,360 B2 1/2019 Osawa et al.
10,252,133 B2 4/2019 Campbell et al.
10,503,965 B2 12/2019 Smith
10,561,916 B1 2/2020 Campbell et al.
10,596,436 B1 3/2020 Campbell et al.
10,639,531 B1 5/2020 Mccarter
10,643,492 B2 5/2020 Lee et al.
10,688,362 B1 6/2020 Sangalang
10,861,200 B1 12/2020 Graham
10,994,182 B1 5/2021 Campbell et al.
11,045,705 B2 6/2021 Zhang
11,247,109 B1 2/2022 Campbell et al.
11,491,383 B1 11/2022 Campbell et al.
11,577,139 B1 2/2023 Campbell et al.
11,577,146 B1 2/2023 Joseph
11,638,854 B2 * 5/2023 Zhang ..... A63B 69/0071 700/91
11,712,610 B1 * 8/2023 Joseph ..... A63B 71/0619 473/447
11,813,510 B1 11/2023 Campbell et al.
2001/0052472 A1 12/2001 Ikeda et al.
2002/0016236 A1 2/2002 Stearns et al.
2002/0072681 A1 6/2002 Schnali
2002/0147404 A1 10/2002 Kato et al.
2003/0073518 A1 4/2003 Marty et al.
2003/0224337 A1 12/2003 Shum et al.
2004/0092840 A1 5/2004 Nakada
2005/0085320 A1 4/2005 Joseph et al.
2005/0172943 A1 8/2005 Cucjen et al.
2005/0187036 A1 8/2005 Ziola et al.
2005/0209051 A1 9/2005 Santomassimo et al.
2005/0215870 A1 9/2005 Rademaker
2006/0057549 A1 3/2006 Prinzel, III et al.
2006/0118096 A1 6/2006 Cucjen et al.
2006/0138809 A1 6/2006 Joseph
2006/0160639 A1 7/2006 Klein
2006/0236993 A1 10/2006 Cucjen et al.
2007/0026974 A1 2/2007 Marty et al.
2007/0208544 A1 9/2007 Kulach et al.
2007/0265138 A1 11/2007 Ashby
2008/0015061 A1 1/2008 Klein
2008/0171620 A1 7/2008 Feldmeier
2008/0254866 A1 10/2008 Young et al.
2008/0261726 A1 10/2008 Chipperfield
2009/0047645 A1 2/2009 Dibenedetto et al.
2009/0137347 A1 5/2009 Jenkins et al.
2009/0191988 A1 7/2009 Klein
2009/0270743 A1 10/2009 Dugan et al.
2009/0325739 A1 12/2009 Gold
2010/0259412 A1 10/2010 Pagonakis
2010/0261557 A1 10/2010 Joseph et al.
2010/0292033 A1 11/2010 Sarver
2011/0084925 A1 4/2011 Baik et al.
2011/0205111 A1 8/2011 Balardeta et al.
2011/0250939 A1 10/2011 Hobler
2012/0015778 A1 1/2012 Lee et al.
2012/0142454 A1 6/2012 Campbell et al.
2012/0309551 A1 12/2012 Holzhacker
2012/0322587 A1 12/2012 Duke
2013/0005512 A1 1/2013 Joseph et al.
2013/0104869 A1 5/2013 Lewis et al.
2013/0104870 A1 5/2013 Rizzo et al.
2013/0157786 A1 6/2013 Joseph et al.
2013/0272393 A1 10/2013 Kirenko et al.
2014/0031703 A1 1/2014 Rayner et al.
2014/0045166 A1 2/2014 Coleman
2014/0081436 A1 3/2014 Crowley et al.
2014/0195019 A1 7/2014 Thurman et al.
2014/0222177 A1 8/2014 Thurman et al.
2014/0244012 A1 8/2014 Doherty et al.

(56) References Cited

U.S. PATENT DOCUMENTS

| | | | |
|---|---|---|---|
| 2014/0305420 | A1 | 10/2014 | Deese |
| 2014/0336796 | A1 | 11/2014 | Agnew |
| 2014/0340329 | A1 | 11/2014 | Chen |
| 2014/0371885 | A1 | 12/2014 | Ianni et al. |
| 2015/0114377 | A1 | 4/2015 | Yoo |
| 2015/0131845 | A1 | 5/2015 | Forouhar et al. |
| 2015/0201134 | A1 | 7/2015 | Carr et al. |
| 2015/0238819 | A1 | 8/2015 | Volkerink et al. |
| 2015/0306455 | A1 | 10/2015 | DeCarlo |
| 2015/0352425 | A1 | 12/2015 | Lewis et al. |
| 2016/0001136 | A1 | 1/2016 | King et al. |
| 2016/0098941 | A1 | 4/2016 | Kerluke |
| 2016/0250540 | A1 | 9/2016 | Joseph et al. |
| 2016/0310814 | A1 | 10/2016 | Joseph et al. |
| 2016/0325166 | A1 | 11/2016 | Wallace |
| 2016/0332054 | A1 | 11/2016 | Smith |
| 2017/0232298 | A1 | 8/2017 | Joseph et al. |
| 2017/0252625 | A1 | 9/2017 | Campbell et al. |
| 2017/0252626 | A1 | 9/2017 | Campbell et al. |
| 2017/0340943 | A1 | 11/2017 | Pierotti et al. |
| 2017/0354845 | A1 | 12/2017 | Williams et al. |
| 2018/0139425 | A1 | 5/2018 | Mutter et al. |
| 2018/0154212 | A1 | 6/2018 | Park et al. |
| 2018/0236338 | A1 | 8/2018 | Campbell et al. |
| 2018/0290019 | A1 | 10/2018 | Rahimi et al. |
| 2020/0009443 | A1 | 1/2020 | Moravchik et al. |
| 2020/0047049 | A1 | 2/2020 | Ahmed |
| 2020/0114243 | A1 | 4/2020 | Janssen |
| 2020/0179755 | A1 | 6/2020 | Ristas |
| 2020/0193863 | A1 | 6/2020 | Smith |
| 2020/0346095 | A1 | 11/2020 | Kubota et al. |
| 2021/0008433 | A1 | 1/2021 | Bush |
| 2021/0052961 | A1 | 2/2021 | Brody |
| 2021/0064880 | A1 | 3/2021 | Zhang et al. |
| 2021/0128977 | A1 | 5/2021 | Picker |
| 2021/0286423 | A1 | 9/2021 | Correia |
| 2021/0370152 | A1 | 12/2021 | Gordon |
| 2023/0119793 | A1* | 4/2023 | Joseph ..... A63B 24/0021 473/447 |

OTHER PUBLICATIONS

Airborne Athletics, Inc., "Dr. Dish Owner's Manual," Oct. 2005, 31 pages.

Brochure entitled "The All New 8000 Series Gun" by Shoot-A-Way before Oct. 12, 2011, 12 pages.

Brochure entitled "The Shoot Away: The perfect Shooting Aid," before Dec. 2, 2011, 1 page.

Reich et al., "A spatial analysis of basketball shot chart data," The American Statistician, Feb. 2006, 60(1):3-12.

Shoot-A-Way, Incredible 8000 Series Gun Basketball Shooting Machine, Sep. 27, 2010, https://www.youtube.conn/watch?v=eOUTA k8eW4 , 1 page (Year: 2010).

Sniper, "Sniper Program Instructions Help with F1," Feb. 10, 1995, 18 pages.

Sniper, "Sniper The Ultimate Basketball Trainer," before Oct. 1995, 4 pages.

* cited by examiner

BASKETBALL TRAINING SYSTEM

CROSS-REFERENCE TO RELATED APPLICATION(S)

This application is a continuation of U.S. patent application Ser. No. 16/811,902 filed Mar. 6, 2020, which claims priority to U.S. patent application Ser. No. 15/805,919 filed Nov. 7, 2017, which claims priority to U.S. Provisional Application No. 62/419,177 filed on Nov. 8, 2016, and entitled "BASKETBALL TRAINING SYSTEM," the contents of which are hereby incorporated by reference in their entirety.

BACKGROUND

This disclosure relates generally to sports training, and in particular to basketball return systems with a user interface.

Training in sports involves the development of skills as well as physical conditioning. The game of basketball requires physical strength and conditioning, and also requires special skills. Successful development of those skills requires repetition during practice.

Although it is a team sport, basketball presents opportunities for an individual player to practice and improve his or her game without the need for other players to be present. A player can develop ball handling skills and shooting skills through individual practice.

Basketball players develop their shooting skills by shooting the basketball from various locations on the court. If a second player is not present to rebound, the shooter must rebound his or her own shots. The rebounding process can waste time that could otherwise be used in taking more shots. Over the past several decades, a number of ball collecting devices have been developed to collect basketballs shot at the basketball goal (i.e. the backboard and the attached hoop). The ball collecting devices generally include netting and a frame for supporting the netting around the basketball goal. The ball collecting devices are often used with a ball delivery device, which directs the ball back to the player.

Motorized ball delivery devices can return basketballs to a shooter at various locations on a basketball court. The ball delivery device can have programs that determine which direction to return balls to the player, how many times to return the ball, etc.

Successful shooting of a basketball can be affected by a number of factors, including a player's form or technique in shooting. In some cases, poor form or technique may have less effect when the player is taking uncontested shots from similar distances, but may limit the player's ability to score in game conditions when the player is guarded by another player and often must attempt shots from varying positions on the court having varying distances from the basketball goal.

As players advance in skill and experience, they are often confronted with the realization that the speed of the game gets "faster," and that he or she will need to consistently score under increasing pressure and from various positions on the court. Continuing to practice under conditions that do not effectively simulate the level of movement required of the shooter and the variety of shot locations frequently encountered in game conditions can result in some improvement in the player's shooting, but may ultimately limit the player's success as the player rises through the levels of play from, e.g., junior varsity to varsity, from high school varsity to college, and from college to professional basketball.

SUMMARY

In one example, a basketball training system includes a server computer and a ball delivery machine. The server computer executes a workout module that manages operation of a graphical user interface that presents a graphical representation of at least a portion of a basketball court and receives user inputs that define a workout program that includes selected ball delivery locations relative to the graphical representation. The ball delivery machine is configured to receive the workout program, and deliver basketballs to the selected ball delivery locations.

In another example, a method includes executing, by a server computer, a workout module that manages operation of a graphical user interface that presents a graphical representation of at least a portion of a basketball court. The method further includes receiving, at the graphical user interface, user inputs that define a workout program that includes selected ball delivery locations relative to the graphical representation, and delivering the workout program to a ball delivery machine having a ball collector and a mechanical ball returner connected to the ball collector for receiving balls from the ball collector and returning balls to a player. The method further includes delivering, by the ball delivery machine, basketballs to the selected ball delivery locations according to the workout program.

DETAILED DESCRIPTION

Figure 1:
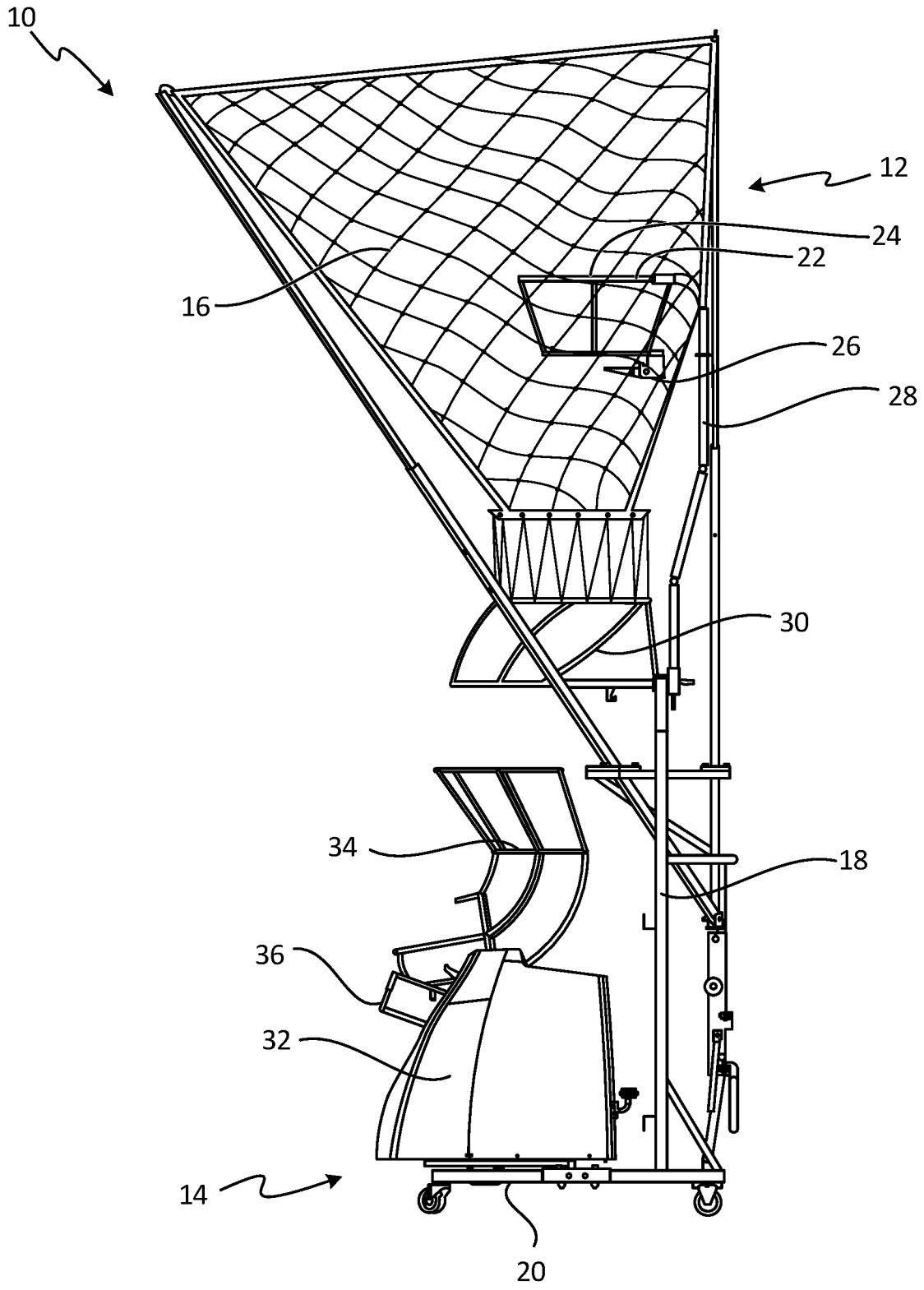
FIG. 1 is a side view of a basketball training machine that includes a ball collection system and a ball delivery system that delivers basketballs to selected ball delivery locations included in a workout program defined via a graphical user interface.

FIG. 1 shows a side view of basketball training machine 10. Basketball training machine 10 includes two main systems, ball collection system 12 and ball delivery system 14. Further description of basketball training machine 10 can be found in currently-pending patent application Ser. No. 15/148,596, filed on May 6, 2016 and entitled BASKETBALL TRAINING SYSTEM.

Ball collection system 12 includes net 16, net frame 18, base 20, shots made counter 22 (which, in this embodiment, includes made shots funnel 24, shots made sensor 26, and counter support frame 28), and upper ball feeder 30. When machine 10 is used for shooting practice, net 16 is positioned in front of a basketball backboard (not shown) so that the basketball hoop and net (not shown) are immediately above shots made counter 22. The size of net 16 is large enough so that missed shots (which do not go through the basketball hoop and net and through shots made counter 22) will still be collected by net 16 and funneled down to upper ball feeder 30.

Ball delivery system 14 includes ball delivery machine 32, main ball feeder 34, and ball ready holder 36. The inlet of main ball feeder 34 is positioned immediately below the outlet of upper ball feeder 30. Ball delivery machine 32 is pivotally mounted on base 20. Ball delivery machine 32 is pivotable about an axis that is aligned with the inlet of main ball feeder 34 and the outlet of upper ball feeder 30. Balls drop out of upper ball feeder 30 into main ball feeder 34. Balls are delivered one at a time from main ball feeder 34 into ball ready holder 36 at the front of ball delivery machine 32. Launch arm 38 (shown in FIG. 2) launches the basketball out of holder 36 to a location on the floor where the player catches the ball and shoots. The location on the floor where the ball is delivered can be changed by pivoting machine 32 with respect to base 20.

As is further described below, ball delivery system 14 is responsive to a graphical user interface that receives user input to define a workout program that includes selected ball delivery locations desired by a user. The graphical user interface presents graphical control elements that enable user interaction to define the workout program. The graphical user interface can be managed by a server device, communicatively coupled with ball delivery system 14 or a separate computing device, to receive the workout program including machine workout instructions executed by ball delivery system 14 and player workout instructions presented to the user. In some examples, the graphical user interface presents a visual representation of at least a portion of a basketball court that is free of indicia representing predetermined ball delivery locations on the basketball court, such as visual markings, buttons, lights, or other physical or graphically-rendered indications of predetermined ball delivery (or shot) locations. In such examples, the graphical user interface enables a greater range of ball delivery locations and player movement that can help to simulate game-like scenarios and increase an effectiveness of training.

The graphical user interface is configured to receive inputs (e.g., gesture input at a touch-sensitive and/or presence-sensitive device, input from a mouse, keyboard, voice command, or other input) relative to the visual representation of the basketball court that identify the selected ball delivery locations. A control system (shown in FIG. 4) of ball delivery system 14 provides control commands to ball delivery machine 32 to cause ball delivery machine 32 to launch basketballs in directions based upon the selected ball delivery locations. In certain examples, the control system provides control commands to ball delivery machine 32 to cause ball delivery machine 32 to launch basketballs at a ball delivery speed that is determined (e.g., automatically determined by the control system) based on a distance between ball delivery machine 32 and the selected ball delivery location. The control system, in some examples, provides control commands to ball delivery machine 32 to cause ball delivery machine 32 to adjust a trajectory of the delivered balls as they exit ball delivery machine 32 to enable effective ball delivery to locations at both shorter and longer distances from ball delivery machine 32, to enable varying types of passes (e.g., bounce passes, chest passes, lob passes, or other types of passes), and/or to accommodate for player height. As such, ball delivery system 14, responsive to the graphical user interface, enables a user (e.g., a player, coach, administrator, training expert, or other user) to define a workout program via the graphical user interface that is communicated to ball delivery machine 32 for execution and, in certain examples, enables selection of desired ball delivery locations that are not limited by indications of predetermined ball delivery locations. In this way, ball delivery system 14 enables the generation of workout programs by differing users via one or more computing devices that are communicatively coupled with a server device that manages operation of the graphical user interface. While described herein with respect to basketball training machine 10, it should be understood that aspects of basketball training machine 10 can be applied to other ball sports as well. For instance, basketball training machine 10 can deliver volleyballs, soccer balls, or other types of balls for training purposes for such other sports. As such, basketball training machine 10 can be considered, in some examples, as a ball sports training machine.

Figure 2:
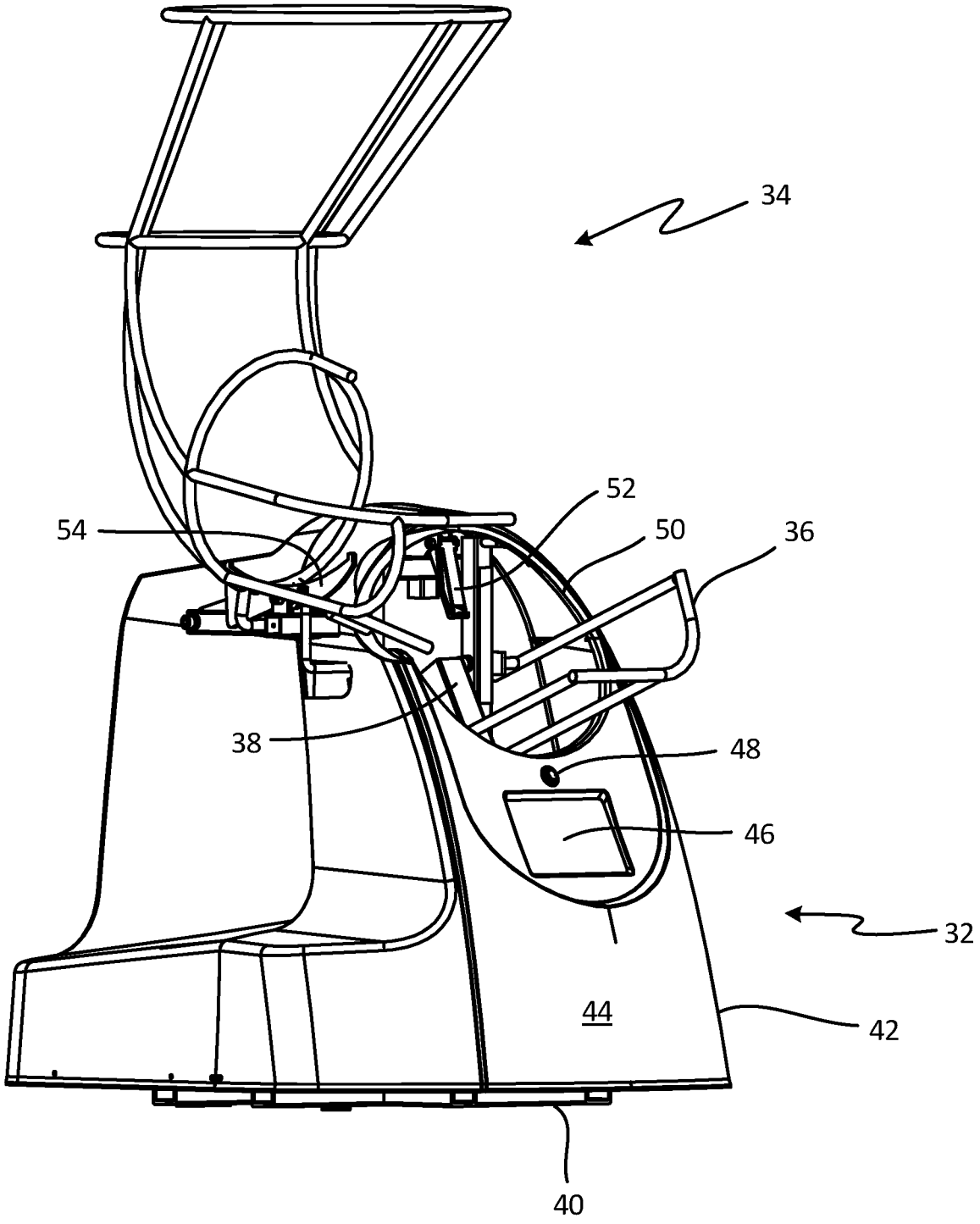
FIG. 2 is a front perspective view of the ball delivery system of FIG. 1.

FIG. 2 is a perspective view of ball delivery system 14 from the front and left of ball delivery machine 32. In this view, ball collection system 12 is not shown. Ball delivery system 14 includes ball delivery machine 32, to which main ball feeder 34 and ball ready holder 36 are mounted. Ball delivery machine 32 includes launch arm 38, bottom platform 40 (which is pivotably mounted to base 20 of ball collection system 12), and outer shell 42 (which encloses the ball launching mechanism and controls that operate machine 32). Front face 44 of outer shell 42 includes electronic front display 46, pre-launch warning light 48 and front opening 50. Also shown in FIG. 2 are ball ready lever 52 and toggle arm 54.

Balls that are collected by ball collection system 12 enter the upper end of main ball feeder 34 and are directed downward and forward to toggle arm 54, which stops further ball movement. When toggle arm 54 is actuated, it pivots to release a single ball to travel further downward and forward into ball ready holder 36. As shown in FIG. 2, ball ready holder 36 slopes downward and rearward through opening 50 into ball delivery machine 32. As the ball rolls down ball ready holder 36 toward launch arm 38, it contacts ball ready lever 52. When ball ready lever 52 is depressed by a ball in ball ready holder 36, it provides a ball ready input signal to the control system of ball delivery machine 32. The ball ready input signal received by the control system causes the control system to initiate a motor driven cycle in which launch arm 38 is engaged and pulled backward while a tension spring is extended. As the cycle continues, launch arm 38 is released and the spring force drives launch arm 38 forward to hit the ball and launch it forward out of ball delivery machine 32 and ball ready holder 36.

Rotation of ball delivery machine 32 relative to base 20 is driven by a gear motor responsive to commands from the control system of ball delivery machine 32 that causes bottom platform 40 to rotate relative to base 20 to cause ball delivery machine 32 to deliver balls, in sequence, to selected ball delivery locations. A direction of rotational movement of bottom platform 40 relative to base 20 is determined and managed by the control system based on an angular distance between sequentially-consecutive ball delivery locations.

In certain examples, one or more portions of ball delivery machine 32 can rotate along a vertical axis of ball delivery machine 32 (i.e., tilt) to adjust a vertical trajectory (i.e., exit angle) of balls delivered out of ball delivery machine 32 and ball ready holder 36. For instance, launching mechanisms of ball delivery machine 32 (e.g., including launch arm 38 and ball ready holder 36) can be pivotally mounted to tilt within ball delivery machine 32 relative to the vertical axis of ball delivery machine 32. Trajectories of delivered balls can be controlled (e.g., via tilt commands from a control system) to account for a distance between ball delivery machine 32 and a selected ball delivery location. For instance, a higher trajectory having a larger arc (e.g., a larger vertical angle of exit trajectory with respect to a horizontal axis extending along base 40) can be determined (and ball delivery machine 32 vertically rotated to provide such trajectory) for longer distances between ball delivery machine 32 and a selected ball delivery location. Similarly, a lower trajectory having a smaller arc (e.g., a smaller vertical angle of exit trajectory with respect to the horizontal axis extending along base 40) can be determined for shorter distances between ball delivery machine 32 and a selected ball delivery location. The trajectory can be determined based on both the ball delivery speed and a selected ball delivery height. As such, ball delivery machine 32 can control ball delivery speed in conjunction with the trajectory of ball delivery to deliver balls to account for varying distances between different selected ball delivery locations and a position of ball delivery machine 32.

In certain examples, a trajectory (i.e., exit angle) of balls launched from ball delivery machine 32 can be determined (or user selected) to account for user height. For instance, a higher trajectory having a larger exit angle with respect to the horizontal axis extending along base 40 (or the ground) can be selected to deliver balls to, e.g., taller users to enable such users to catch the ball at an elevation that is between the user's waist and the user's head. Similarly, a lower trajectory having a smaller exit angle with respect to the horizontal axis can be selected to delivery balls to, e.g., shorter users to enable such users to catch the ball at an elevation that is between the shorter user's waist and head. In certain examples, the trajectory of balls launched from ball delivery machine 32 can be determined (or user selected) to provide a type of pass, such as a bounce pass configured to bounce the ball prior to reaching the ball delivery location, a lob pass configured to have a large arcing trajectory toward the ball delivery location, or other types of passes. Indications of user selected height and/or type of pass can be received at a user interface operatively connected to the controller, as is further described below.

Accordingly, ball delivery machine 32 can be controlled (e.g., by a control system) to pivot both horizontally to deliver balls to a plurality of selected ball delivery locations and vertically (i.e., tilt) to adjust the trajectory of the delivered balls. As such, ball delivery machine 32 can be automatically controlled to enable training of game-like scenarios where a user may receive passes at varying locations and distances on the court as well as varying types of passes (e.g., chest passes, bounce passes, lob passes, or other types of passes) and passes having varying delivery speeds and delivery elevations. Ball delivery machine 32, therefore, can help to better simulate such game-like scenarios than a ball delivery machine that is limited to, e.g., fixed trajectories and ball delivery speeds at predetermined ball delivery locations, such as at locations spaced around the three-point line.

Figure 3:
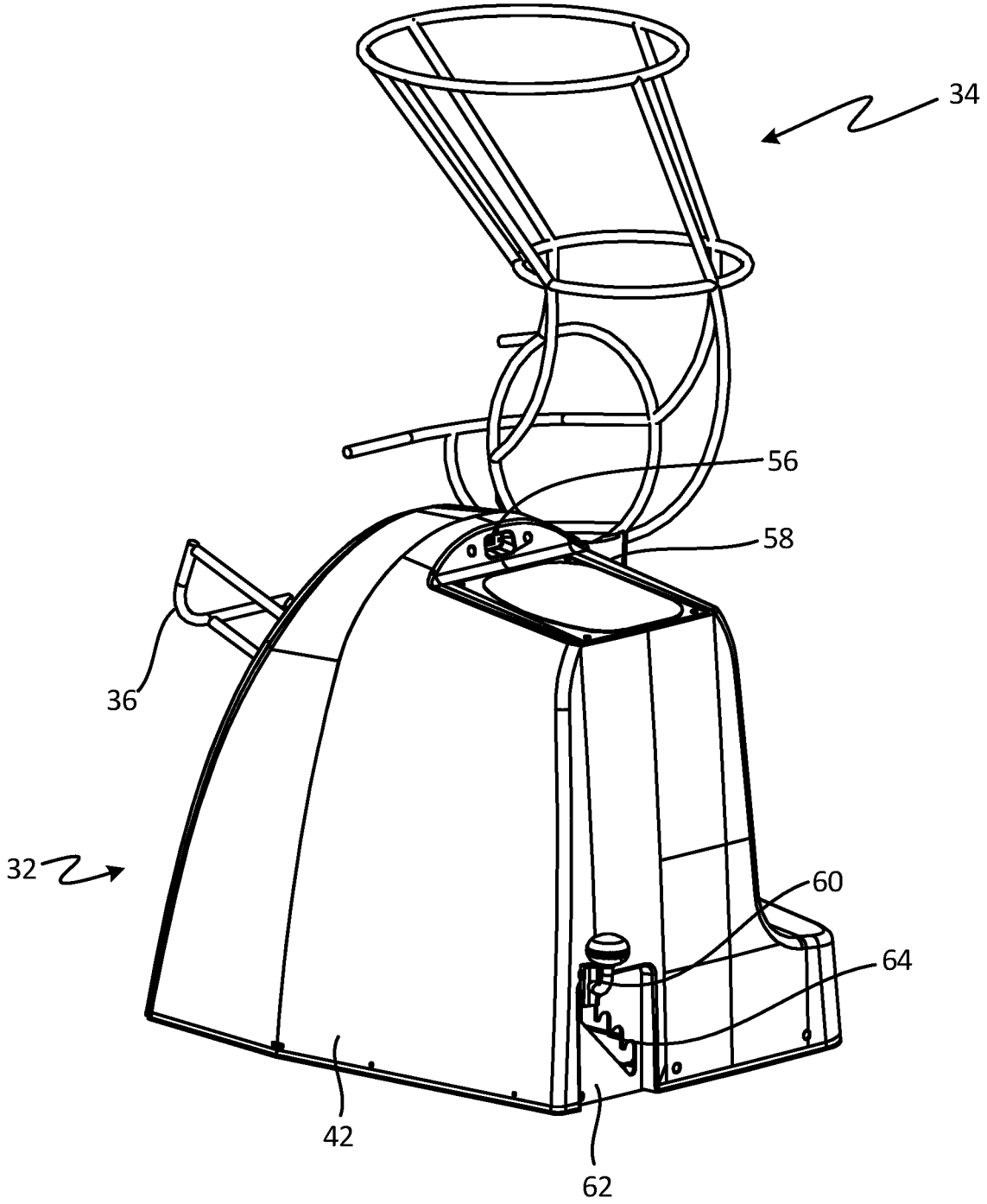
FIG. 3 is a rear perspective view of the ball delivery system of FIG. 1.

FIG. 3 is a perspective view of ball delivery system 14 from the rear and right of ball delivery machine 32. At the top of shell 42 are Universal Serial Bus (USB) port 56 and console 58, which allow a user to input information and select operating modes of ball delivery machine 32, and to receive outputs including data collected by machine as well as menus, instructions, and prompts. In some examples, ball delivery machine 32 may not include console 58 and/or USB port 56. Rather, in such examples, ball delivery machine 32 may receive and output information via a communication device (e.g., one or more wired and/or wireless transceivers) operatively coupled to one or more remote computing devices, such as mobile phones (including smartphones), personal digital assistants (PDAs), tablet computers, laptop computers, desktop computers, server systems, mainframes, or other remote computing devices.

As illustrated in FIG. 3, at the rear of ball delivery machine 32 are ball distance adjustment knob 60 and ball distance pre-select plate 62. Knob 60 and plate 62 are used, in some examples, to change the spring tension or preload on the spring that drives launch arm 38. The greater the preload, the further the distance the ball will be driven by launch arm 38 when it is released. In the embodiment shown in FIG. 3, plate 62 contains diagonal notched track 64, which includes five notches at which the tension rod connected to adjustment knob 60 can be positioned. The lower the position of knob 60, the greater the preload and the farther the ball will be launched.

In some examples, a delivery speed of balls driven by launch arm 38 (i.e., a speed at which launch arm 38 propels balls out of ball delivery machine 32) is set by a ball delivery speed adjustment actuator (shown in FIG. 4) controlled by the control system of ball delivery machine 32. For example, the ball delivery speed adjustment actuator can adjust a tension of the spring (or other tensioning element) that drives launch arm 38 forward to hit the ball and launch it forward out of ball delivery machine 32. In certain examples, the ball delivery speed adjustment actuator adjusts a drawback distance by which launch arm 38 is pulled backward to modify the spring tension utilized to propel launch arm 38 forward to hit the ball. In other examples, launch arm 38 is not propelled forward by a tensioning element, but rather is motor driven to propel launch arm 38 forward at a speed corresponding to a determined ball delivery speed.

The ball delivery speed can be determined by the control system based on a distance between ball delivery machine 32 and a ball delivery location. For example, the control system can determine a physical distance between ball delivery machine 32 and one or more selected ball delivery locations based on a relative distance between graphically-rendered locations of ball delivery machine 32 and the one or more selected ball delivery locations on a visual representation of at least a portion of a basketball court, as is further described below. The control system can determine the ball delivery speed based on (e.g., proportional to) the determined physical distances.

In some examples, the control system can modify the ball delivery speed for each selected ball delivery location. In other examples, the control system can determine the ball delivery speed for groups of selected ball delivery locations within threshold distances from ball delivery machine 32. In yet other examples, the control system can determine a single ball delivery speed based on an average of the distances between ball delivery machine 32 and each of the ball delivery locations, a maximum of the distances, a minimum of the distances, or other aggregations of the distances between ball delivery machine 32 and the selected ball delivery locations. In some examples, the control system may not modify the ball delivery speed. Rather, in such examples, the ball delivery speed may be manually adjusted via ball distance adjustment knob 60 (and ball distance pre-select plate 62).

Figure 4:
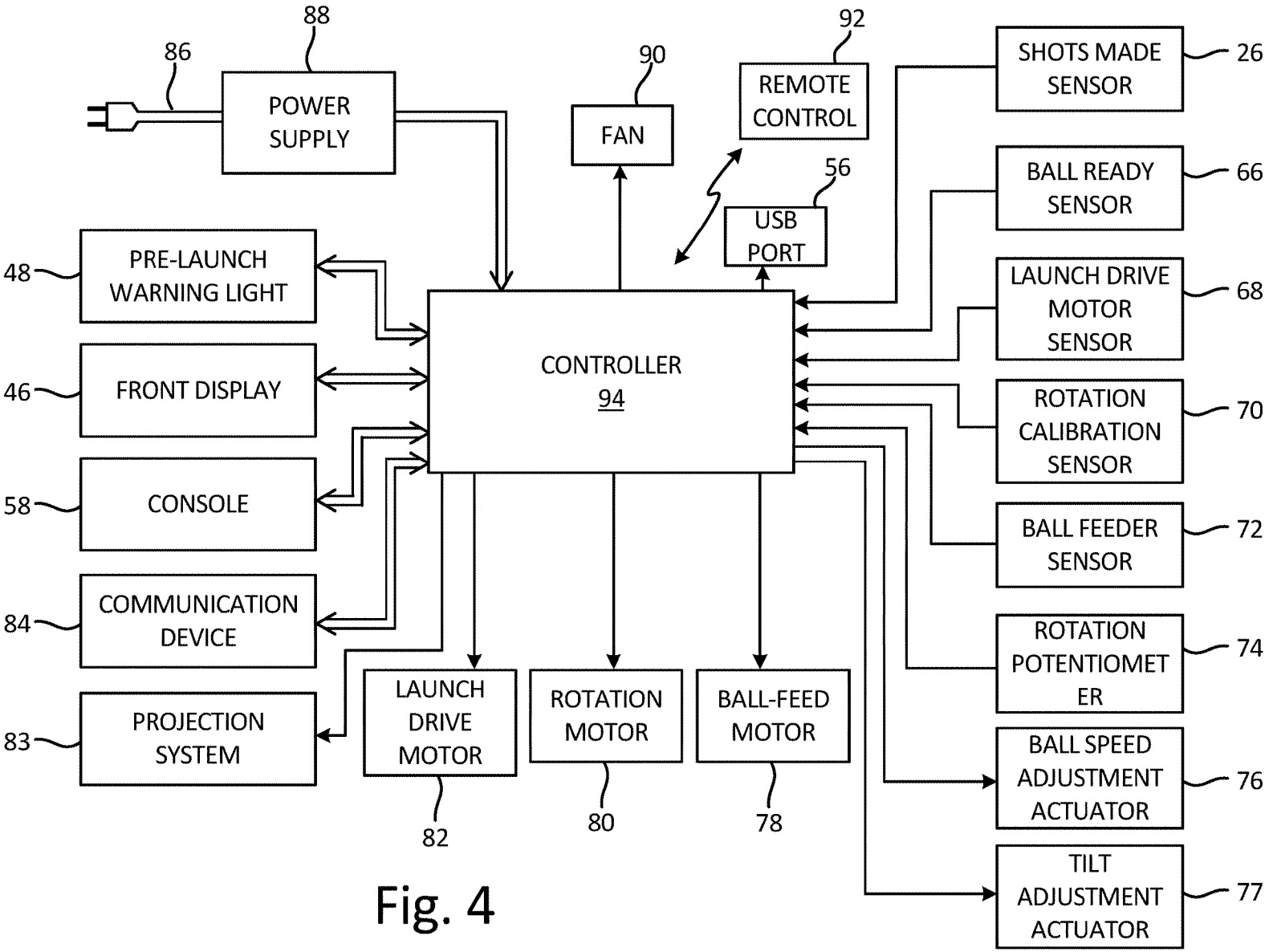
FIG. 4 is a block diagram of the control system of the ball delivery system.

FIG. 4 is a block diagram of the control system of the ball delivery system 14. Shown in FIG. 4 are shots made sensor 26, front display 46, pre-launch warning light 48, USB port 56, console 58, ball ready sensor 66, launch drive motor sensor 68, rotation calibration sensor 70, ball feed sensor 72, rotation potentiometer 74, ball speed adjustment actuator 76, tilt adjustment actuator 77, ball feeder toggle motor 78, rotation motor 80, launch drive motor 82, projection system 83, communication device 84, AC cable 86, power supply 88, fan 90, remote control 92, and controller 94.

Controller 94 is a processor-based controller that coordinates the operation of components of the control system. Controller 94 includes one or more processors and computer-readable memory encoded with instructions that, when executed by the one or more processors, cause controller 94 to operate in accordance with techniques described herein. Examples of one or more processors of controller 94 can include any one or more of a microprocessor, a controller, a digital signal processor (DSP), an application specific integrated circuit (ASIC), a field-programmable gate array (FPGA), or other equivalent discrete or integrated logic circuitry.

Computer-readable memory of controller 94 can be configured to store information within controller 94 during operation. Computer-readable memory of controller 94, in some examples, is described as computer-readable storage media. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, the computer-readable memory is a temporary memory, meaning that a primary purpose of the computer-readable memory is not long-term storage. Computer-readable memory, in some examples, includes volatile memory that does not maintain stored contents when electrical power to controller 94 is removed. Examples of volatile memories can include random access memories (RAM), dynamic random access memories (DRAM), static random access memories (SRAM), and other forms of volatile memories. In some examples, computer-readable memory of controller 94 is used to store program instructions for execution by the one or more processors of controller 94. For instance, computer-readable memory of controller 94, in some examples, is used by software or applications running on controller 94 to temporarily store information during program execution.

Computer-readable memory of controller 94, in some examples, also includes one or more computer-readable storage media that can be configured to store larger amounts of information than volatile memory. In some examples, computer-readable memory of controller 94 includes non-volatile storage elements. Examples of such non-volatile storage elements can include magnetic hard discs, optical discs, floppy discs, flash memories, or forms of electrically programmable memories (EPROM) or electrically erasable and programmable (EEPROM) memories.

Sensors 26, 66, 68, and 72 are used by controller 94 in coordinating and controller the operation of motors 78, 80, 82, as well as ball speed adjustment actuator 76 and tilt adjustment actuator 77. Calibration sensors 70 are used by controller 94 during setup to provide calibration of the signal from potentiometer 74, which is used to determine the rotational position of ball delivery machine 32.

Controller 94 utilizes communication device(s) 84 to communicate with external devices via one or more wired or wireless communication networks, or both. Communication device(s) 84 can include any one or more communication devices, such as network interface cards (e.g., Ethernet cards), optical transceivers, radio frequency transceivers, Bluetooth transceivers, 3G or 4G transceivers, and WiFi radio computing devices.

In operation, controller 94 communicates with, e.g., a remote computing device to receive a workout program including indications of positions of selected ball delivery locations, ball delivery timing (e.g., tempo) information, a number of balls delivered per location, a type of pass (e.g., chest pass, bounce pass, lob pass, or other type of pass), a selected ball delivery height, and position information of ball delivery machine 32 relative to a visual representation of at least a portion of a basketball court presented by a graphical user interface executed by, e.g., a remote server device. As is further described below, controller 94 controls operation of components of the control system, such as ball speed adjustment actuator 76, tilt adjustment actuator 77, ball feeder toggle motor 78, rotation motor 80, and launch drive motor 82 to deliver balls to the selected ball delivery locations according to the received information. In certain examples, controller 94 controls operation of projection system 83 to project optical indications on the basketball court. For example, projection system 83 can include one or more light sources (e.g., LEDs, halogen or incandescent light bulbs, or other light sources) configured to be angularly controlled to emit visible light at locations and/or patterns on the basketball court. The one or more light sources can be colored light sources (or controllable to emit a determined light color). Controller 94 can control operation of projection system 83 to project optical indications, such as colored or uncolored light spots on the basketball court to visually indicate, e.g., one or more of a next selected ball delivery location, a next user shot location, or other indications, as is further described below.

As such, controller 94 controls operation of components of the control system of ball delivery machine 32 to deliver balls to selected ball delivery locations according to, e.g., user instructions received via a graphical user interface that presents a visual representation of at least a portion of a basketball court.

Figure 5:
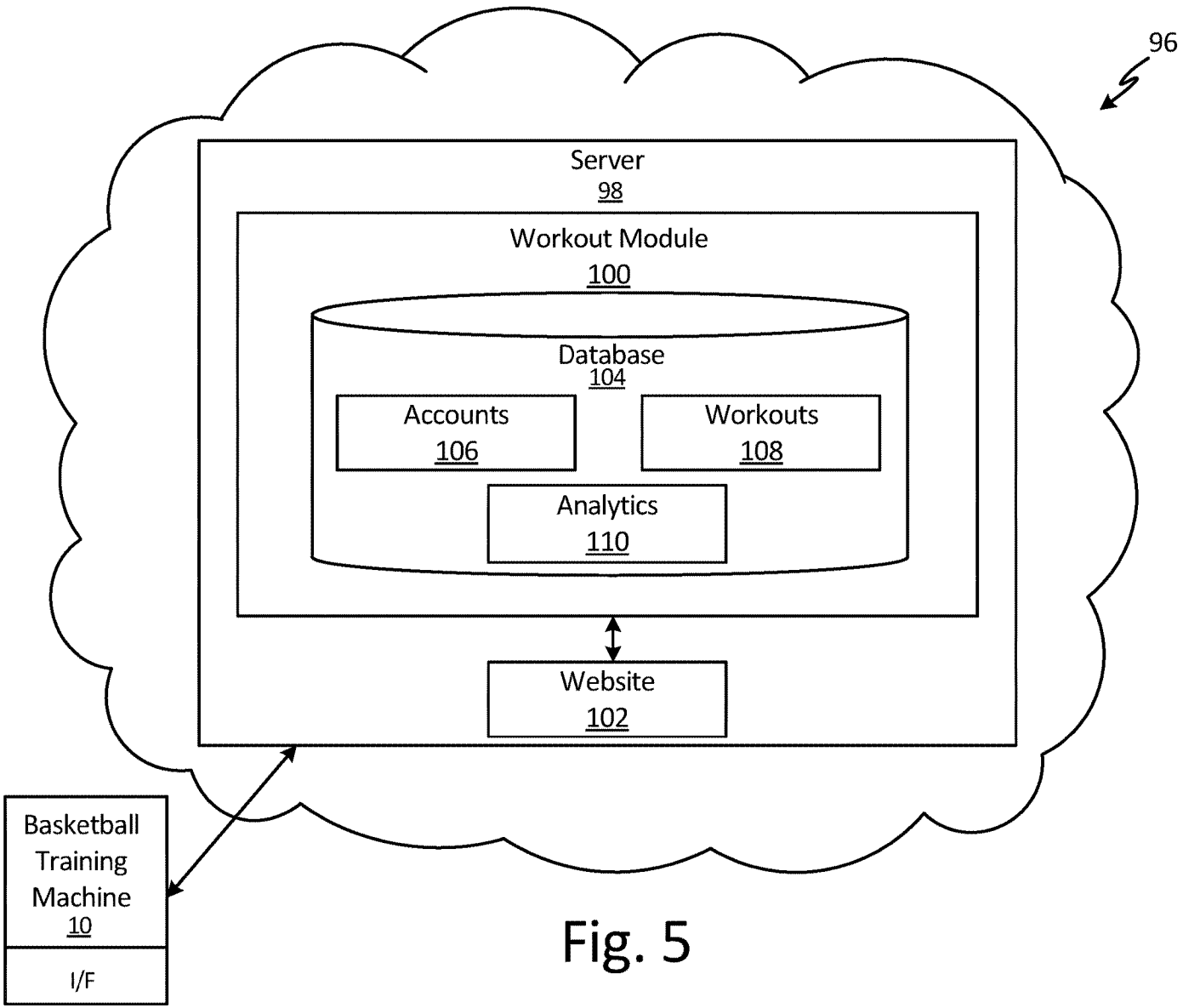
FIG. 5 is a block diagram of a basketball training system that includes a basketball training machine communicatively coupled with a server that executes a workout module to generate a workout program executed by the basketball training machine.

FIG. 5 is a block diagram of basketball training system 96 that includes basketball training machine 10 communicatively coupled with server 98 that executes workout module 100 to generate a workout program executed by basketball training machine 10. As illustrated in FIG. 5, server 98 includes workout module 100 and website 102. Workout module 100 includes database 104, which includes accounts 106, workouts 108, and analytics 110.

Server 98, as illustrated in FIG. 5, can be a cloud-based or otherwise remote server computer including one or more processors and computer-readable memory encoded with instructions that, when executed by the one or more processors, cause server 98 to execute workout module 100 and website 102 according to techniques described herein. Examples of server 98 include, but are not limited to, mainframe computers, desktop computers, laptop computers, or other computing devices capable of implementing workout module 100 and managing operation of (e.g., serving of) website 102. In some examples, rather than a single server device, server 98 may be implemented as a server system including a plurality of interconnected server computers that distribute functionality attributed herein to server 98 among the multiple server computers. For instance, in certain examples, server 98 can be implemented as a server system including a first server computer that executes workout module 100 and a second server computer that executes (e.g., serves) website 102. Similarly, while database 104 is illustrated as included in workout module 100 of server 98, database 104 can include any one or more databases that may be local to server 98 or distributed among any one or more server devices operatively connected to server 98.

Database 104 can be a relational database, hierarchical database, multidimensional database, or other type of database capable of storing information in an organized manner for later retrieval by, e.g., workout module 100 and/or website 102. Database 104, as illustrated in FIG. 5, includes accounts 106. Accounts 106 represents account information stored within database 104 and associated with one or more user accounts managed by, e.g., an administrative entity of server 98 (e.g., a manufacturer of basketball training machine a workout programs supplier, or other administrative entity). Accounts 106 includes identity information associated with each of a plurality of user accounts. Identity information includes a unique identifier of the user account (e.g., a user name, user identification number, or other unique identifier), a user passcode (e.g., password, numerical passcode, or alphanumeric passcode including both textual and numerical characters), or other information uniquely associating a user with a corresponding account stored in accounts 106. Accounts 106, in certain examples, includes account parameters for each of the plurality of accounts. Examples of such account parameters include a user skill level, such as middle school player skill level, high school player skill level, collegiate player skill level, professional player skill level, or other skill levels.

In certain examples, accounts 106 associates any one or more of the plurality of accounts with one or more account groups. Account groups are groupings of individual accounts that may be commonly associated via e.g., a team, a school, a peer group, or other common association. For instance, account groups can include team accounts, school accounts, trainer group accounts, coach group accounts, or other group accounts. Accounts 106 can associate individual user accounts with any one or more account groups. For instance, accounts 106 can simultaneously associate a particular user account with one of a plurality of school account groups, one of a plurality of team account groups, and one of a plurality of skill level account groups. Account groups of accounts 106 can be hierarchical in nature, such that account groups can be associated with one or more higher level parent (or other ancestral) account groups and/or one or more child (or other descendant) accounts (or account groups). For instance, each team account group can be hierarchically related as a child account group of a school account group that represents the parent account group to the team account group. Similarly, member accounts (or account groups) of the team account group can be considered child accounts (or account groups) of the team account, and therefore hierarchically related to each of the ancestral team account group and school account groups. As such, user accounts and account groups can be affiliated via ancestral and descendant relationships to provide a hierarchical relationship of user accounts and/or account groups.

Workouts 108 store workout programs that include machine workout instructions that are executed by basketball training machine 10 to deliver basketballs to selected ball delivery locations as well as player workout instructions that represent player activity (e.g., player movement, skill development activities such as dribbling or other ball handling maneuvers, exercise activities such as pushups or sit-ups, or other player activity). Workouts 108 are associated with attributes, such as a workout skill level, workout intensity level, workout time, workout type (e.g., offensive skills development, long range shooting development, short range shooting development, free throw shooting development, agility development, strength development, ball handling development, physical conditioning development, or other workout type), or other attributes. Attributes of workout programs included in workouts 108 can indicate whether a particular workout program (or grouping of workout programs included in, e.g., a workout library) is user-modifiable. For instance, a workout program can be specified (e.g., during creation) as non-modifiable. Non-modifiable workout programs can be executed by players at basketball training machine 10 but not modified by the player prior to execution, thereby providing a common workout program that can be executed (without modification) by multiple players associated with multiple user accounts to enable benchmarking or other comparisons of player skill and/or conditioning, as is further described below.

Workout programs stored at workouts 108 can be associated with any one or more accounts and/or account groups stored in database 104 at accounts 106. For instance, a particular workout program can be associated with (e.g., assigned to) an account group corresponding to a team, and therefore also associated with each individual user account that is a member of the team account group through the hierarchical relationship between the parent team account group and the child user accounts. Workout programs stored at workouts 108 can be associated with a single account of accounts 106 or multiple accounts of accounts 106. As such, workout programs can be generated and stored at workouts 108 of database 104 and utilized by a single user account or shared between multiple user accounts or account groups.

Analytics 110 of database 104 store analytics data (e.g., statistics) associated with any one or more accounts stored at accounts 106 and/or workout programs stored at workouts 108. Examples of analytics data include shooting percentage data, a number of attempted shots, a usage time of basketball training machine 10, user heart rate data during any one or more workout programs (e.g., sensed by a heart rate monitor or other physical monitoring device worn by a player during a workout program), shooting percentage relative to heart rate, movement, position on the basketball court, or other analytics data. Analytics data stored at analytics 110 of data base 104 can be associated with a workout program, such that each user account that executes a particular workout program contributes to shared analytics corresponding to the executed workout program. In general, analytics 110 can store any statistical or other analytical data that corresponds to user accounts, user account groups (e.g., team account groups), and workout programs to enable comparison of performance between user accounts, between user accounts and benchmark performance criteria, between time-separated performances of a single user account (or account group), or other comparisons. As such, analytics data stored at analytics 110 can enable a coach, player, or other user to track performance of a single player or group of players over time, to compare performances between players or groups of players, and to track progress of skill development and conditioning of players or groups of players.

As illustrated in FIG. 5, server 98 executes website 102, though in other examples website 102 can be executed by a separate computing device, such as a dedicated web server device. Website 102 is communicatively coupled with workout module 100 to provide a user interface that enables user interaction with workout module 100 to create and select workout programs and view analytics data stored at database 104, as is further described below.

Basketball training machine 10 is communicatively coupled with server 98 to access website 102 via any one or more wired or wireless communication networks, such as a cellular communication network, local area network (LAN), wide area network (WAN) such as the Internet, wireless LAN (WLAN), or other type of communication network. Basketball training machine 10, as illustrated in FIG. 5, includes an interface (illustrated as UF), such as console 58, a touchscreen interface, a keyboard and/or mouse interface, or other type of interface to enable user interaction with website 102 to create a workout program and/or select a workout program stored at workouts 108 for execution by basketball training machine 10.

In operation, a user accesses website 102 via the interface of basketball training machine 10 to select a workout program stored at workouts 108 and/or create a new workout program via the interface provided by website 102 and managed by workout module 100. Server 98 transmits the selected or created workout program to basketball training machine 10. The workout program includes both machine workout instructions for execution by basketball training machine 10 and player workout instructions representing player activity during workout program. Basketball training machine 10 executes the machine workout instructions by delivering basketballs to identified ball delivery locations at a selected tempo (i.e., relative timing) and tracking made and missed shots via shots made sensor 26. Basketball training machine 10 presents the player instructions for review prior to execution of the workout program and, in certain examples, presents the player instructions during execution of the workout program via a display, speakers, or other output device. Results of the workout program corresponding to made and missed shots, duration of one or more portions of the workout program, or other analytics data can be transmitted by basketball training machine 10 to workout module 100 of server 98 via website 102 (e.g., automatically transmitted or transmitted in response to user input to upload the results to server 98). Accordingly, system 96 enables a user to select one or more workout programs stored at workouts 108 of database 104, create a new workout program that can optionally be stored in workouts 108, and execute the workout program to enable effective training for the player.

Figure 6:
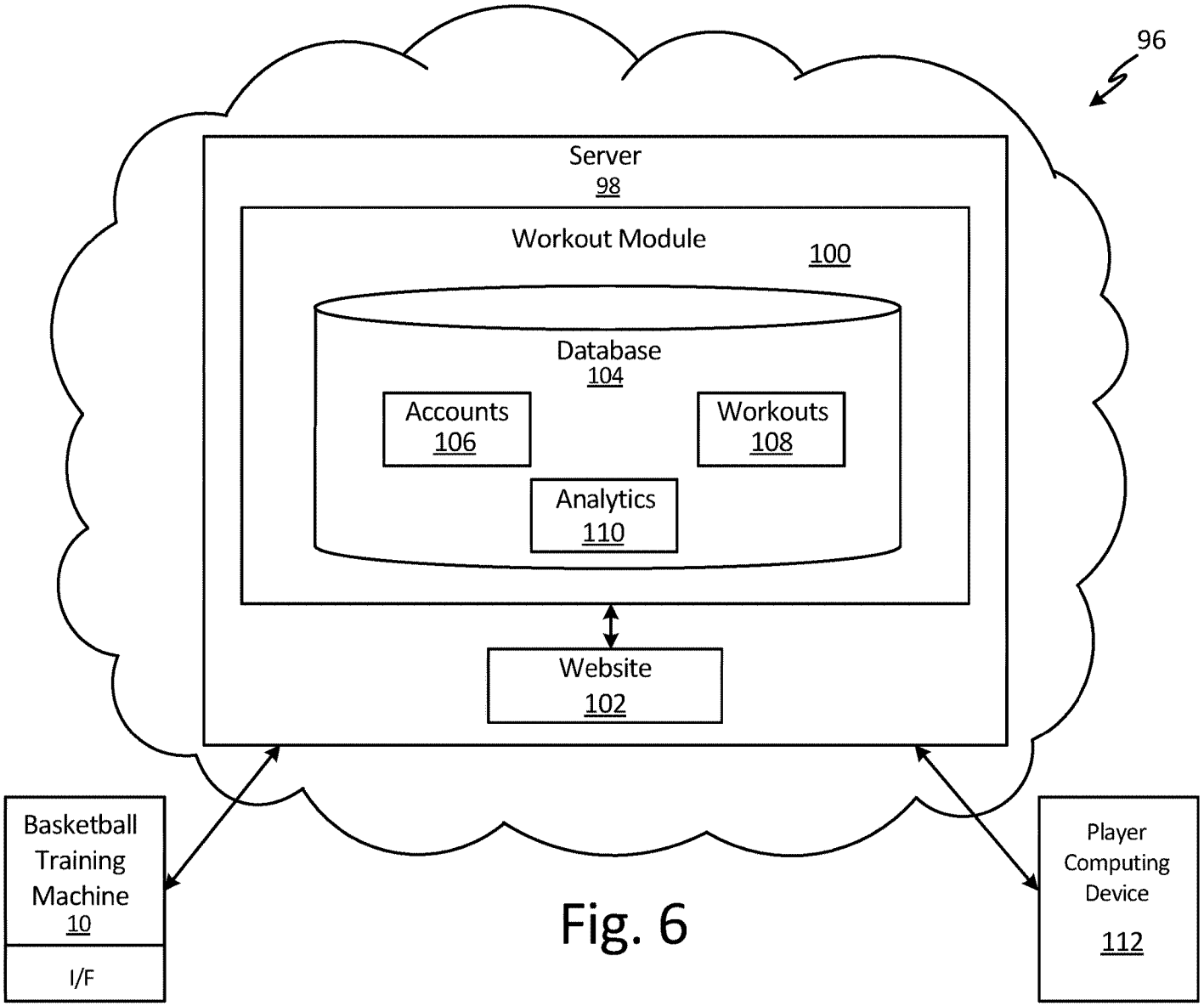
FIG. 6 is a block diagram of another embodiment of the basketball training system including the basketball training machine and a player computing device, each communicatively coupled with the server.

FIG. 6 is a block diagram of another embodiment of basketball training system 96 including basketball training machine 10 and player computing device 112, each communicatively coupled with server 98. That is, in the example of FIG. 6, basketball training system 96 also includes player computing device 112 that is communicatively coupled with server 98 via one or more wired or wireless communication networks, or both. Examples of player computing device 112 include tablet computers, mobile phones (including smartphones), laptop computers, wearable devices such as smartwatches, or other computing devices that can communicate with server 98 to interface with workout module 100. For instance, player computing device 112 can interface with workout module 100 by accessing website 102 via, e.g., the Internet. In some examples, player computing device 112 executes a software application (often referred to as an app) that establishes a communicative connection with server 98 via website 102 or other separate communicative connection and presents a graphical user interface to enable user interaction with workout module 100 to select a workout program stored at workouts 108 of database 104 and/or create a workout program for execution by basketball training machine 10. Though basketball training machine 10 is illustrated in the example of FIG. 6 as including an interface (I/F), basketball training machine 10 need not include a user interface in all examples. For instance, as in the example of FIG. 6, player computing device 112 can serve as the user interface enabling interaction of the player with server 98 and basketball training machine 10.

In operation, a player utilizes player computing device 112 (e.g., a smartphone) to execute an application (e.g., an app) that interfaces with workout module 100 or to access website 102 via a web browser that presents a graphical user interface managed by workout module 100. The graphical user interface presents a login screen that enables the player to provide account login information, such as username and passcode. Workout module 100 accesses the account stored in accounts 106 associated with the login information (or enables the player to create a new account) and presents the user with graphical control elements to either select a workout program stored at workouts 108 of database 104 or create a new workout program, as is further described below.

In response to receiving a selection via player computing device 112 of a stored workout program or creation of a new workout program, server 98 transmits the selected or created workout program including the machine workout instructions and the player workout instructions to basketball training machine 10 via, e.g., website 102 or a separate communicative connection between server 98 and basketball training machine 10. Basketball training machine 10 executes the workout program and generates analytics data in the form of workout results (e.g., made and missed shots, workout timing, or other results) and transmits the results to server 98. Server 98 transmits the results to player computing device 112 which presents the results to the player via a display or other output device of player computing device 112. In some examples, workout module 100 can automatically store the workout results at analytics 110 of database 104 and associate the results with the corresponding user account in accounts 106. In other examples, workout module 100 can store the workout results only in response to received user input via the graphical user interface provided at player computing device 112 to store (e.g., upload) the results to server 98. Accordingly, player computing device 112 can provide a graphical user interface and communication connection that enables user interaction with basketball training machine 10 via server 98. In addition, player computing device 112 can enable player interaction with server 98 to upload results, view and/or create workout programs, or otherwise interact with server 98 whenever player computing device 112 has a communicative connection with server 98 (e.g., via an Internet connection), thereby enabling player interaction from locations that may be remote from basketball training machine 10.

Figure 7:
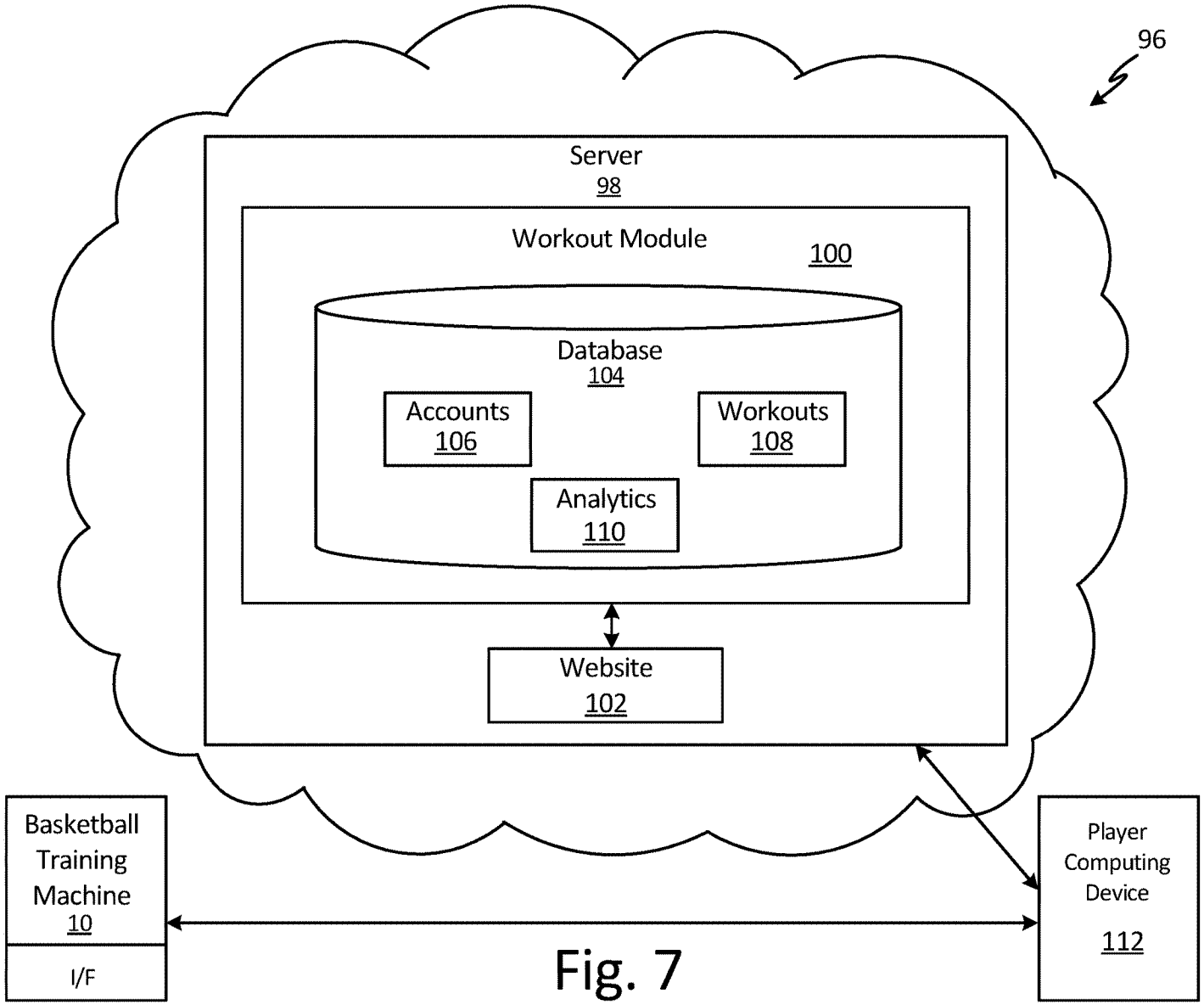
FIG. 7 is a block diagram of another embodiment of the basketball training system including the player computing device communicatively coupled with the server and the basketball training machine communicatively coupled with the player computing device.

FIG. 7 is a block diagram of another embodiment of basketball training system 96 including player computing device 112 communicatively coupled with server 98 and basketball training machine 10 communicatively coupled with player computing device 112. That is, in the example of FIG. 7, basketball training machine 10 is not directly connected to server 98, but rather is directly connected to player computing device 112 via a wired and/or wireless network connection. For instance, player computing device 112 can connect with basketball training machine 10 via a wireless Bluetooth connection, LAN connection, WLAN connection, or other communicative connection.

In the example of FIG. 7, player computing device 112 enables user interaction with server 98 to select a workout program and/or create a new workout program via, e.g., website 102 that is managed by and interfaces with workout module 100. In operation, server 98 transmits the selected or created workout program including the machine workout instructions and player workout instructions to player computing device 112. Player computing device 112 transmits the workout program to basketball training machine 10 via the communicative connection between player computing device 112 and basketball training machine 10. Basketball training machine 10 executes the workout program and transmits results to player computing device 112. Player computing device 112, in this example, transmits the results (automatically or in response to user input to upload the results) to server 98, which stores the results at database 104. As such, player computing device 112 can provide both a user interface and communicative connection to enable user interaction with basketball training machine 10 as well as a communicative connection between basketball training machine 10 and server 98. In this way, basketball training machine 10 need not have a communicative connection with server 98 to receive and execute workout programs stored at or created via workout module 100. As such, player computing device 112 can provide the communicative connection enabling interaction between basketball training machine 10 and server 98 in examples where basketball training machine 10 is either not Internet enabled or does not have access to a wireless network capable of interfacing with server 98.

Figure 8:
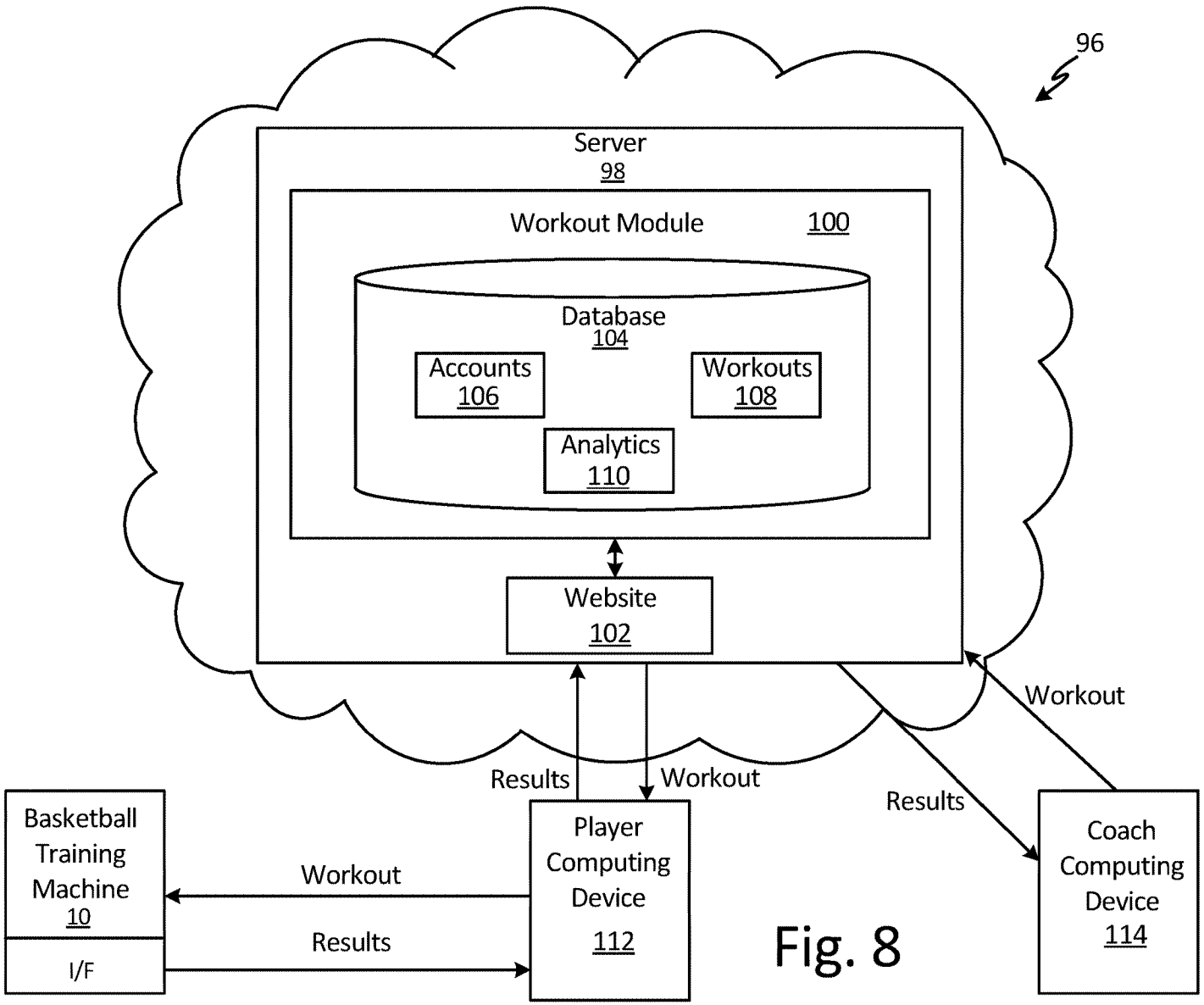
FIG. 8 is a block diagram of another embodiment of the basketball training system including the player computing device and a coach computing device each communicatively coupled with the server, and the basketball training machine communicatively coupled with the player computing device.

FIG. 8 is a block diagram of another embodiment of basketball training system 96 including player computing device 112 and coach computing device 114 each communicatively coupled with server 98, and basketball training machine 10 communicatively coupled with player computing device 112. That is, in the example of FIG. 8, basketball training system 96 also includes coach computing device 114 that is communicatively coupled with server 98 via one or more wired or wireless communication networks. Examples of coach computing device 114 include laptop computers, desktop computers, tablet computers, mobile phones (e.g., smartphones), or other computing devices that can communicate with server 98 to interface with workout module 100. In general, coach computing device 114 provides an additional interface with server 98 to create, select, and/or modify workout programs via workout module 100.

In operation, a coach (or other user) accesses website 102 via coach computing device 114, which may be located remotely from basketball training machine 10 (e.g., in a coach's office or other remote location) to create a workout program via the user interface presented by website 102 and managed by workout module 100. In some examples, coach computing device 114 can assign a created or stored workout program to one or more accounts and/or account groups stored at accounts 106 of database 104. In certain examples, coach computing device 114 can modify a stored workout program prior to assigning the workout program to one or more accounts within database 104.

As illustrated in FIG. 8, coach computing device 114 accesses server 98 via website 102 managed by workout module 100 to create a new workout program, access (and, in some examples, modify) a workout program stored at workouts 108, and assign the workout program to one or more accounts. Player computing device 112, accessing server 98 via, e.g., an app or website 102, receives a notification that a workout program has been created for (or assigned to) an account to which a player is logged in via player computing device 112. In response, player computing device 112 downloads the workout program from server 98 (e.g., via the app or website 102) automatically or in response to player input via received via player computing device 112 to download the workout program. Player computing device 112 transmits the workout program to basketball training machine 10, including both machine workout instructions and player workout instructions, via a wired or wireless connection between player computing device 112 and basketball training machine 10. In other examples, such as when basketball training machine 10 is communicatively coupled with server 98 (e.g., via Internet connection), basketball training machine 10 can receive the workout program via the communicative connection with server 98. Basketball training machine 10 executes the workout program, and transmits the workout results (e.g., made shots, missed shots, workout timing information, or other analytics data) to player computing device 112, which uploads the results to server 98 (e.g., automatically or in response to user input to upload the results). Server 98 stores the workout results at analytics 110 of database 104 and associates the workout results with the user account in accounts 106 to which the player logged in via player computing device 112. Server 98 further transmits the workout results to coach computing device 114 (e.g., automatically or in response to user input to retrieve the results from coach computing device 114, such as via website 102).

Coach computing device 114 can access and/or modify goals and practice plans, managed by workout module 100 and stored at database 104 and associated with one or more of accounts 106. For example, workout module 100 can present graphical control elements via, e.g., website 102 to enable a coach or other user to create and assign goals to one or more of accounts 106. Examples of goals include number of attempted shots goals, number of made shots goals, total training time goals, shooting percentage goals, or other goals. Practice plans can include one or more workout programs assigned to the one or more of accounts 106 that can be designed to help a player achieve a desired level of performance, such as one or more goals associated with a player account.

In some examples, coach computing device 114 can access and modify scheduling corresponding to a time schedule of the use of basketball training machine 10 associated with one or more of accounts 106. For instance, workout module 100 can present graphical control elements, such as graphical calendaring control elements, via website 102 to enable a coach or other user to schedule workout times during which a corresponding account is designated for use of basketball training machine 10. Accordingly, scheduling controls managed by workout module 100 can enable the coach or other user (e.g., player) to assign workout times to one or more accounts (or account groups) to enable effective scheduling and use of basketball training machine 10 which may be utilized by multiple players associated with multiple accounts. In some examples, the coach or other user can assign a workout time to an account within accounts 106. In response, workout module 100 can transmit a notification to the corresponding account (e.g., via a notification on an app executing on player computing device 112) indicating the scheduled workout time. In certain examples, a player or other user can reserve a workout time via, e.g., player computing device 112. In response, calendaring controls managed by workout module 100 can associate the reserved time with the corresponding account and can indicate to other accessing accounts that the time is reserved.

Accordingly, basketball training system 96 including coach computing device 114 that interfaces with workout module 100 via, e.g., website 102, enables coach (or other third party) interaction with workout module 100 to create new workout programs, access and/or modify stored workout programs, assign workout programs, goals, and/or workout programs to individual and/or group accounts, schedule use of basketball training machine 10 among multiple accounts, and track progress of the corresponding players via coach computing device 114. Such remote access via coach computing device 114 can enable the coach or other user to, e.g., setup workout routines for a team or tailored to individual players at times and locations that may be more convenient than during a practice session at a basketball facility where basketball training machine 10 is located. Moreover, the coach or other user can access and review training results corresponding to the workout programs at any time or location that the coach or other user can access server 98 via a communicative connection between coach computing device 114 and server 98, such as during non-practice hours. As such, basketball training system 96 that enables remote access to server 98 via coach computing device 114 provides greater flexibility for coaches or other users to generate workout programs and review workout results than other systems that may require colocation of the coach or other user with basketball training machine 10 to access such workout program generation and review operations.

Figure 9:
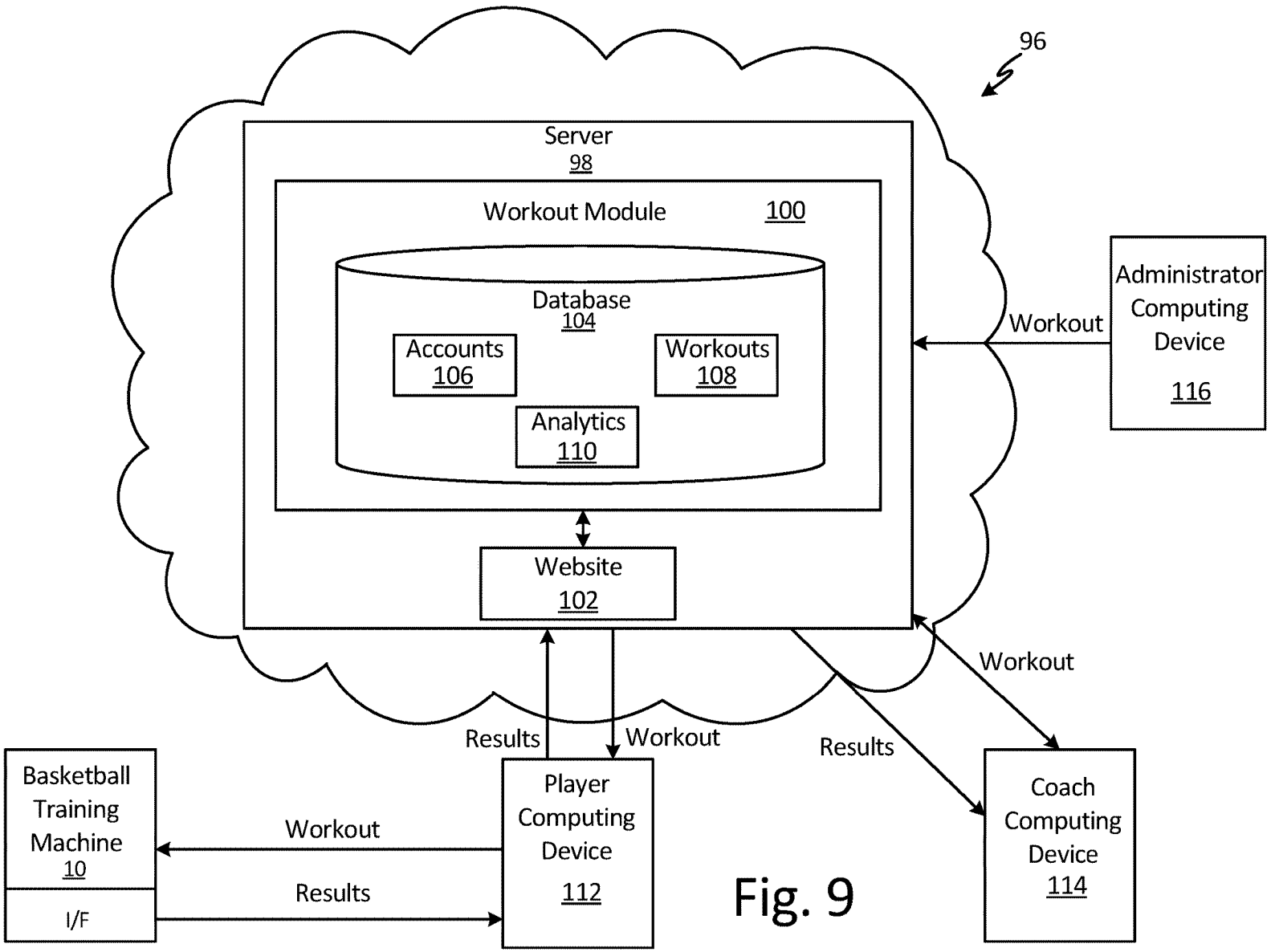
FIG. 9 is a block diagram of another embodiment of the basketball training system including the player computing device, the coach computing device, and an administrator computing device each communicatively coupled with the server, and the basketball training machine communicatively coupled with the player computing device.

FIG. 9 is a block diagram of another embodiment of basketball training system 96 including player computing device 112, coach computing device 114, and administrator computing device 116 each communicatively coupled with server 98, and basketball training machine 10 communicatively coupled with player computing device 112. That is, in the example of FIG. 9, basketball training system 96 also includes administrator computing device 116 that is communicatively coupled with server 98 via one or more wired or wireless communication networks. Examples of administrator computing device 116 include desktop computers, laptop computers, tablet computers, mobile phones (including smartphones), or other computing devices that can communicate with server 98 to interface with workout module 100. Administrator computing device 116 can be, e.g., a device that is located at or otherwise managed by an administrative entity of server 98, such as a manufacturer of basketball training machine 10 or other administrative entity.

As illustrated in FIG. 9, administrator computing device 116 accesses server 98 via, e.g., website 102, to create, store, and/or modify workout programs stored at workouts 108 of database 104. For instance, administrator computing device 116 can be utilized by an administrative entity to create workout programs that are stored at workouts 108 and assigned to any one or more accounts or account groups stored at accounts 106 of database 104. For example, administrator computing device 116 can access website 102 to create a library (or libraries) of workout programs that can be accessed by coach computing device 114 to select workout programs and assign the selected workout programs to user accounts that are downloaded by player computing device 112 for execution by basketball training machine 10.

In some examples, administrator computing device 116 can designate any one or more workout programs as non-modifiable. Non-modifiable workout programs can be selected by coach computing device 114 and/or player computing device 112 for execution by basketball training machine 10, but are not modifiable via non-administrator accounts. Administrator accounts are those accounts that are associated with an administrative entity that accesses server 98 via, e.g., administrator computing device 116. Such non-modifiable workout programs can be executed by multiple players and/or coaches to compare workout performance among the multiple players. Accordingly, an administrator or other entity accessing server 98 via an administrator account (e.g., via administrator computing device 116) can provide common workout programs that can be selected (e.g., by coaches) and performed by multiple players, the results of which serve as an objective measure of the players' abilities to perform the workout programs. In this way, the common workout programs can help a coach in selecting players for game-time performance and in helping coaches to guide players to improve performance.

In certain examples, the non-modifiable workout programs can include benchmark criteria, such as benchmark shot performance criteria (e.g., a number of made shots, a number of shots taken in a given time duration, a percentage of made shots, or other benchmark shot performance criteria). In some example, the benchmark criteria can correspond to performance of the non-modifiable workout program by a particular player, such as a particular professional player. In such examples, players (e.g., high school players) executing the workout program can compare their workout results to those of the benchmark player (e.g., professional player), thereby providing a reference for comparison and a performance goal to achieve.

As described above, those workout programs not designated as non-modifiable can be modified via, e.g., coach computing device 114 and/or player computing device 112. For instance, database 104 can store a library of modifiable workout programs at workouts 108. A coach or other user accessing workouts 108 via coach computing device 114 or a player accessing workouts 108 via player computing device 112 can select one of the workout programs and modify any one or more aspects of the workout program prior to transmitting the workout program to basketball training machine 10 for execution.

Accordingly, basketball training system 96 can enable an administrator or other entity to provide workout programs that can be selected by coaches and/or players for execution by basketball training machine 10. The workout programs can be modifiable or non-modifiable to enable both modifiable templates of workout programs as well as non-modifiable workout programs that can be used for benchmarking or other comparisons of player performance.

Figure 10:
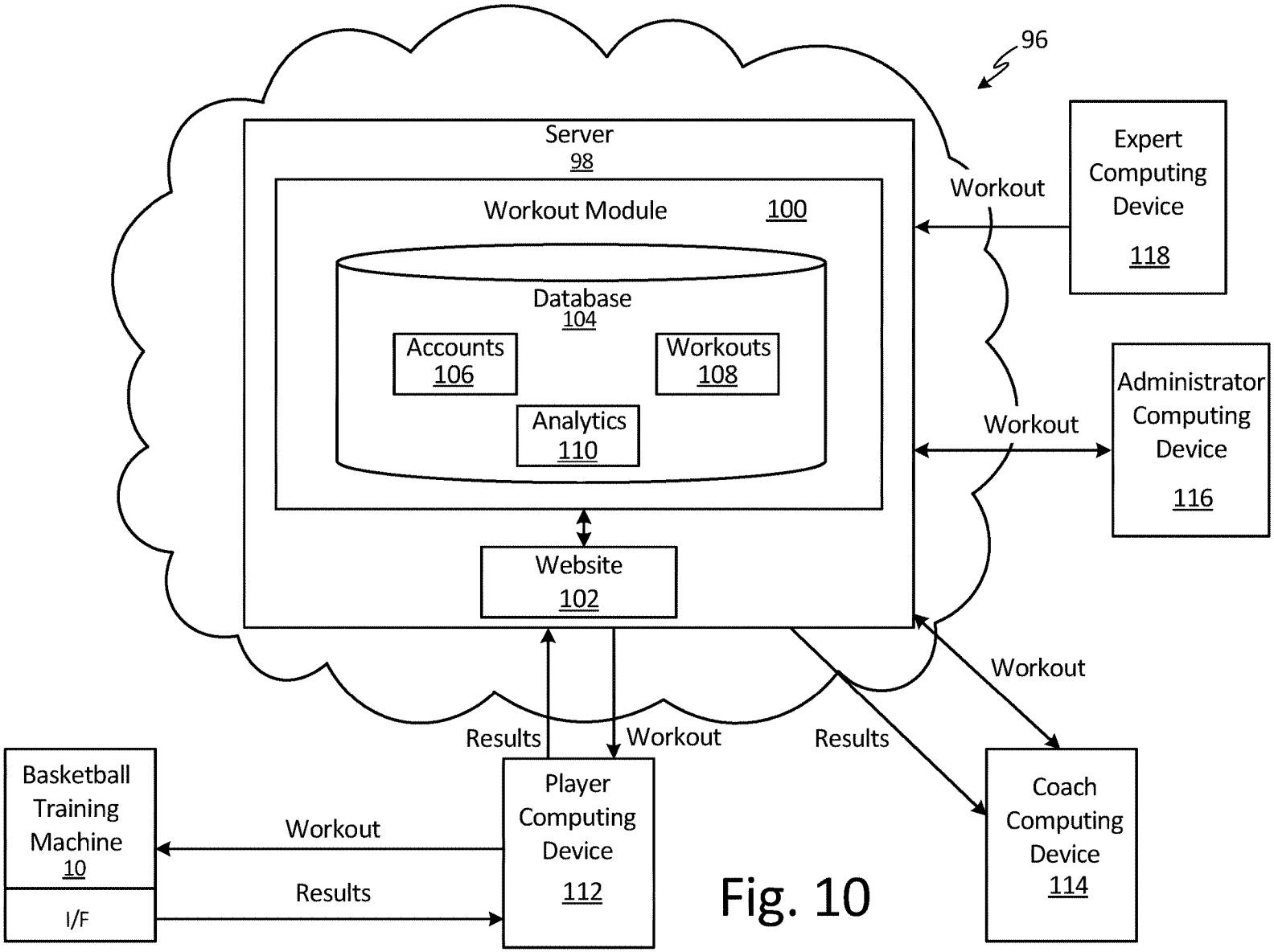
FIG. 10 is a block diagram of another embodiment of the basketball training system including the player computing device, the coach computing device, the administrator computing device, and an expert computing device each communicatively coupled with the server, and the basketball training machine communicatively coupled with the player computing device.

FIG. 10 is a block diagram of another embodiment of basketball training system 96 including player computing device 112, coach computing device 114, administrator computing device 116, and expert computing device 118 each communicatively coupled with server 98, and basketball training machine 10 communicatively coupled with player computing device 112. That is, in the example of FIG. 10, basketball training system 96 also includes expert computing device 118 that is communicatively coupled with server 98 via one or more wired or wireless communication networks. Examples of expert computing device 118 include desktop computers, laptop computers, tablet computers, mobile phones such as smartphones, or other computing devices that can communicate with server 98 to interface with workout module 100.

In the example of FIG. 10, expert computing device 118 can be utilized by a sports training entity (e.g., trainer) or other basketball training expert to provide workout programs that are stored at workouts 108 of database 104. As an example, a training expert, such as a professional or collegiate level basketball coach, a sports trainer, or other expert can access server 98 via website 102 managed by workout module 100 to generate workout programs (e.g., a workout library) corresponding to, e.g., various workout regimens specifically targeted to increase a player's performance in one or more aspects of the game of basketball. Workout programs generated by the expert (e.g., via expert computing device 118) can be accessed and reviewed by an administrator via administrator computing device 116. The administrator can assign any one or more of the workout programs (and, in some examples, rejecting certain workout programs) to any one or more accounts, account groups, or workout libraries stored at database 104. Coach computing device 114, in one example, accesses a library of expert workout programs and assigns one or more of the expert workout programs to corresponding accounts stored at accounts 106 of database 104. A player associated with one of the accounts receives a notification from workout module 100 that a new workout program (i.e., the expert workout program in this example) has been assigned to that player and downloads the workout program via player computing device 112. Player computing device 112 transmits the workout program to basketball training machine 10 (or, in some examples, basketball training machine 10 downloads the workout program direction from server 98). Basketball training machine 10 executes the expert workout program and transmits results to player computing device 112. Player computing device 112 transmits the results, automatically or in response to user input to upload the results, to server 98. A coach or other user can access the results stored at analytics 110 of database 104 via website 102 accessed from, e.g., coach computing device 114. Accordingly, system 96 can enable basketball training experts to provide workout programs that can be vetted by an administrator and selected for use by a coach and/or player with basketball training machine 10. Results of the executed workout program can be stored at database 104 and viewed (and analyzed) by the player and/or coach. As such, system 96 enables coaches and/or players to access workout programs designed for execution on basketball training machine 10 by basketball training experts that may not be directly affiliated with the player, coach, or team, but rather may provide such workout programs as a service (e.g., paid or otherwise) to individuals and groups associated with (e.g., having access to) server 98.

A basketball training system implementing techniques described herein can therefore enable players, coaches, teams, or other entities to generate workout programs for execution by basketball training machine 10 using a graphical user interface managed by workout module 100 and presented via website 102 or other graphical interface. The workout programs can be stored at server 98 (or other computing device accessible by server 98) to enable later retrieval and possible sharing of workout programs among multiple user accounts. The user accounts can be associated with any one or more user groups, thereby facilitating such sharing of workout programs among affiliated users. Workout results, stored by database 104 as analytics 110 and associated with any one or more accounts 106 and/or workouts 108, can be retrieved by any computing device communicatively coupled with server 98 and having access to a corresponding one of accounts 106. In this way, analytics data corresponding to workout results can be reviewed, shared, and analyzed by coaches, players, or other users to facilitate the efficient and effective training of players. The ability of workout module 100 to automatically modify workout programs in response to graphical control elements that select a corresponding skill level or duration of the workout program enables users (e.g., players, coaches, or other users) to efficiently utilize training time for active training with basketball training machine 10, rather than spending such time modifying workout programs to fit the timing constraints or skill level of the player. Moreover, libraries of workout programs generated by an administrator or training expert can enable the coach and/or player to select stored workout programs designed by training experts to draw from their expertise without having direct affiliation (e.g., time spent with) the particular training expert. Accordingly, system 96 implementing workout module 100 to generate workout programs for execution by basketball training machine 10 can significantly enhance the effectiveness and efficiency of the training experience using basketball training machine 10.

FIGS. 11-24 are screenshots of graphical user interface 120 presented by, e.g., website 102 and managed by workout module 100. For purposes of clarity and ease of discussion, the screenshots of FIGS. 11-24 are described below within the context of basketball training system 96 of FIGS. 5-10.

Figure 11:
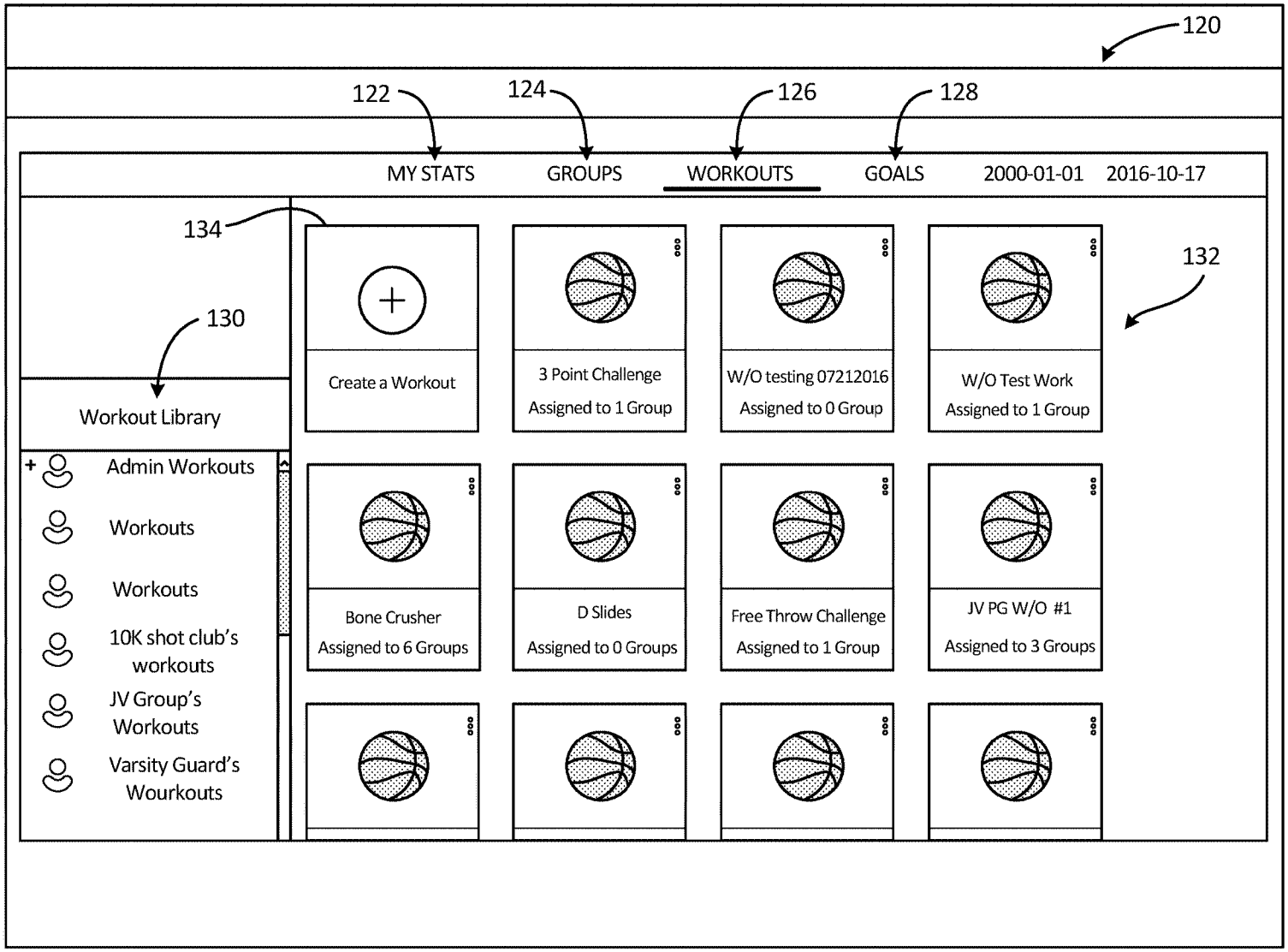
FIGS. 11-24 are screenshots of a graphical user interface managed by a workout module executed by the server.

As illustrated in FIG. 11, graphical user interface 120 includes My Stats contents tab 122, Groups contents tab 124, Workouts contents tab 126, and Goals contents tab 128. FIG. 11 is a screenshot of graphical user interface 120 presented when Workouts content tab 126 is selected. As illustrated, graphical user interface 120 further includes workouts library 130 and workouts selection region 132. Workouts library 130 presents selectable libraries of workout programs as well as an indication of a number of workout programs included in each workout library. Workouts library 130 presents libraries of workout programs that are stored at workouts 108 and accessible by an actively logged in account of accounts 106 stored in database 104. In response to receiving an indication of user selection to access one of the selectable libraries of workout programs presented by workouts library 130, workout module 100 causes graphical user interface 120 to present selectable icons representing the individual workout programs included in the selected workout library at workouts selection region 132.

As illustrated, graphical user interface 120 presents a plurality of workout programs at workouts selection region 132. Each of the workout programs corresponds to a workout program stored at workouts 108 and accessible by (e.g., associated with) the actively logged in user account stored at accounts 106 of database 104. In addition to the plurality of workout programs, graphical user interface 120 presents workout creation icon 134 that is user selectable to initiate the workout creation process through which the user is led by graphical user interface 120 as managed by workout module 100.

Figure 12:
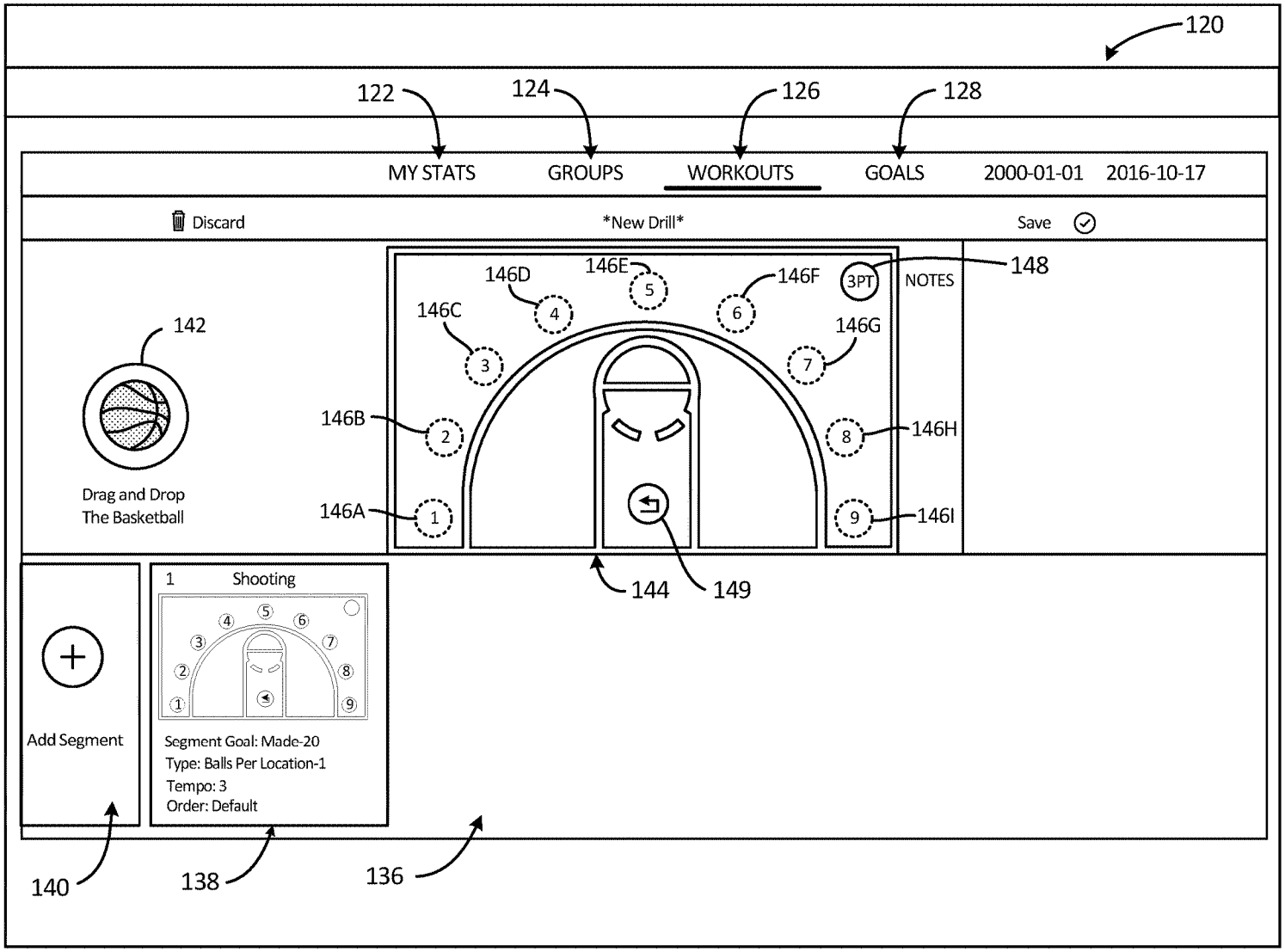

FIG. 12 is a screenshot illustrating graphical user interface 120 after workout creation icon 134 is selected. As illustrated in FIG. 12, in response to a selection of workout creation icon 134, graphical user interface 120 presents workout segments region 136 including shooting segment 138 and segment addition icon 140. In addition, graphical user interface 120 presents ball delivery selection icon 142 as well as ball delivery location region 144. Ball delivery location region 144 displays a graphical representation of a portion of a basketball court having candidate ball delivery locations 146A, 146B, 146C, 146D, 146E, 146F, 146G, 146H, and 146I spaced angularly about a location of a basketball goal, point value allocation icon 148, ball delivery order icon 149, and segment notes region 150.

Workout segments region 136 displays indications of segments of the workout program. That is, workout module 100 divides workout programs into a series of segments, each corresponding to a category of workout program activities. For instance, as is further described below, categories of workout program activities can include shooting segments, resting segments, physical exercise segments (e.g., sit ups, pushups, or other physical exercises), customizable segments, or other categories of workout program activities. In some examples, such as the example of FIG. 12, workout module 100 generates an initial starting segment as a shooting segment, though in other examples, workout module 100 may generate other categories of initial starting segments, or no initial starting segment.

Shooting segment 138 includes indications of segment parameters corresponding to a goal parameter, a type parameter, a tempo parameter, and an order parameter. Each of the goal, type, tempo, and order parameters are user selectable to modify the respective segment parameters. For example, the goal parameter is user selectable to select a made shots goal corresponding to a total number of made shots for the segment, a shots taken goal corresponding to a total number of attempted shots (or delivered basketballs) for the segment, and a time duration goal corresponding to a total time duration of the segment. Each parameter is further selectable to specify a value of the parameter, such as a number of made shots, a number of shots taken, and the total time duration goal. The type parameter is user selectable to specify a number of shots to be made, a number of shots to be taken, or a number of consecutive made shots. The tempo parameter is user selectable to select (e.g., increase and decrease) a ball delivery tempo. Increasing the ball delivery tempo decreases a time duration between consecutively delivered basketballs. Decreasing the ball delivery tempo increases a time duration between consecutively delivered basketballs. The order parameter is user selectable to select whether basketballs are delivered in a default order (e.g., from left to right, from right to left, or other default order) or a customized order corresponding to, e.g., an order of selected ball delivery locations. Ball delivery icon 149 is illustrated in the example of FIG. 12 as presenting an indication of a default ball delivery order corresponding to a left-to-right order followed by a right-to-left order. Ball delivery icon 149 displays, in response to a selected customized ball delivery order, an indication that the selected delivery order has been customized. Segment addition icon 140 enables user selection input to add an additional segment to the workout program, as is further described below.

Candidate ball delivery locations 146A-146I graphically represent candidate ball delivery locations to which ball delivery machine 10 will deliver basketballs during execution of the workout program. Ball delivery selection icon 142 is user selectable to identify any one or more of candidate ball delivery locations 146A-146I as selected ball delivery locations. For instance, in the example of FIG. 12, ball delivery selection icon 142 is user selectable via drag-and-drop actuation to identify selected ball delivery locations from candidate ball delivery locations 146A-146I. Point value allocation icon 148 is user selectable to select a point value allocation (e.g., three-point value, two-point value, or free throw) for purposes of generation of analytics data stored at, e.g., analytics 110 of database 104. Segment notes region 150 receives and stores alphanumeric text input corresponding to, e.g., segment notes or other user-provided information corresponding the segment.

Figure 13:
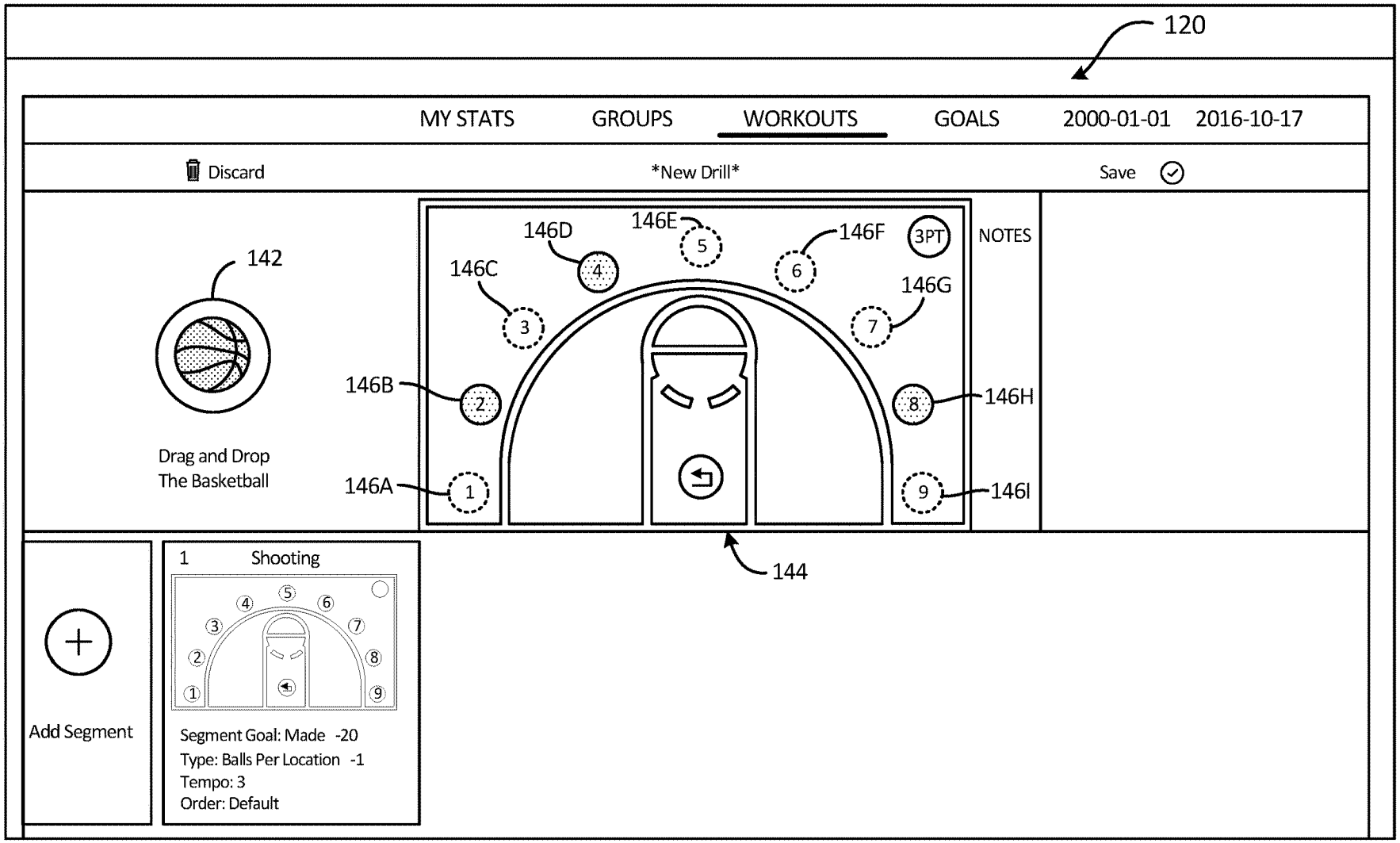

FIG. 13 is a screenshot illustrating graphical user interface 120 after receiving user input (e.g., drag-and-drop input of ball delivery selection icon 142) to select candidate ball delivery locations 146B, 146D, and 146H as selected ball delivery locations. As illustrated in FIG. 13, ball delivery location region 144 displays each of candidate ball delivery locations 146A-146I including a number corresponding a sequential order of ball delivery to the candidate ball delivery locations. That is, candidate ball delivery location 146A illustrates the numeral 1 corresponding to a first order of ball delivery, and candidate ball delivery location 146I illustrates the numeral 9 corresponding to a ninth (or last) order of ball delivery. In the example of FIG. 13, only candidate ball delivery locations 146B, 146D, and 146H are identified via user input as selected ball delivery locations. As such, ball delivery machine 10 in the example of FIG. 13 delivers basketballs first to selected ball delivery location 146B, second to selected ball delivery location 146D, and third to selected ball delivery location 146H corresponding to the relative order of candidate ball delivery locations 146B, 146D, and 146H in a default left-to-right ordering of ball delivery.

Figure 14:
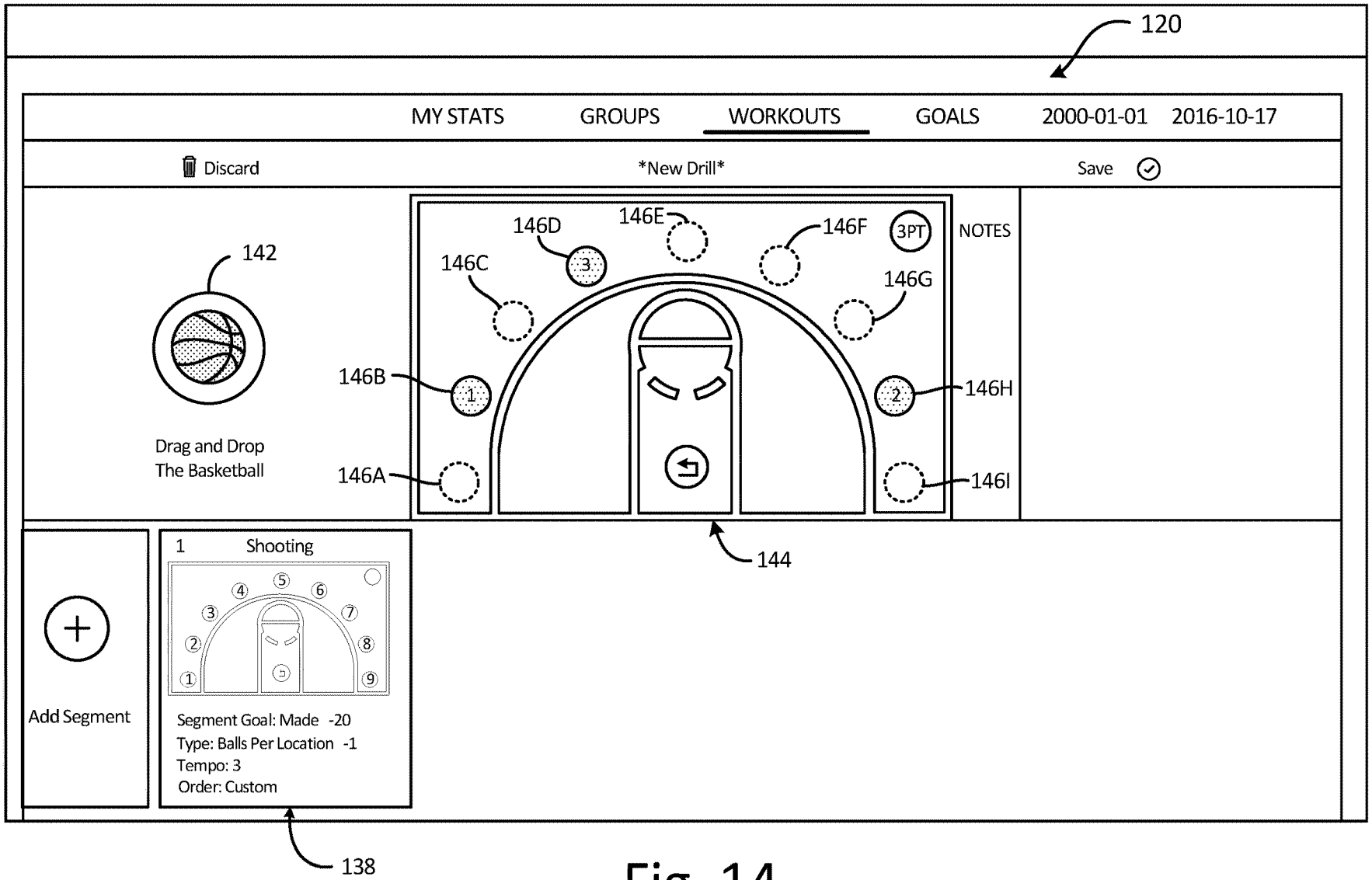

FIG. 14 is a screenshot illustrating graphical user interface 120 after receiving user selection input to specify a customized order parameter of shooting segment 138. As illustrated in FIG. 14, ball delivery location region 144 displays each of candidate ball delivery locations 146A-146I. However, in the example of FIG. 14, ball delivery location region 144 displays numerals only with selected ball delivery locations 146B, 146D, and 146H. That is, in response to receiving the user selection input to specify the customized order parameter of shooting segment 138, ball delivery location region 144 displays a numeral 1 with selected ball delivery location 146B, a numeral 2 with selected ball delivery location 146D, and a numeral 3 with selected ball delivery location 146H. The numerals displayed with selected ball delivery locations 146B, 146D, and 146H correspond to an order of ball delivery to selected ball delivery locations 146B, 146D, and 146H determined by workout module 100 in response to an order of selection of selected ball delivery locations 146B, 146D, and 146H. That is, in the example of FIG. 14, selected ball delivery location 146B was first selected, selected ball delivery location 146H was next selected, and selected ball delivery location 146D was last selected. Workout module 100, in response to receiving the user selection input to specify the customized order parameter of shooting segment 138, specifies the ball delivery location order as first to selected ball delivery location 146B, next to selected ball delivery location 146H, and last to selected ball delivery location 146D corresponding to the relative selection order of selected ball delivery locations 146B, 146D, and 146H.

Figure 15:
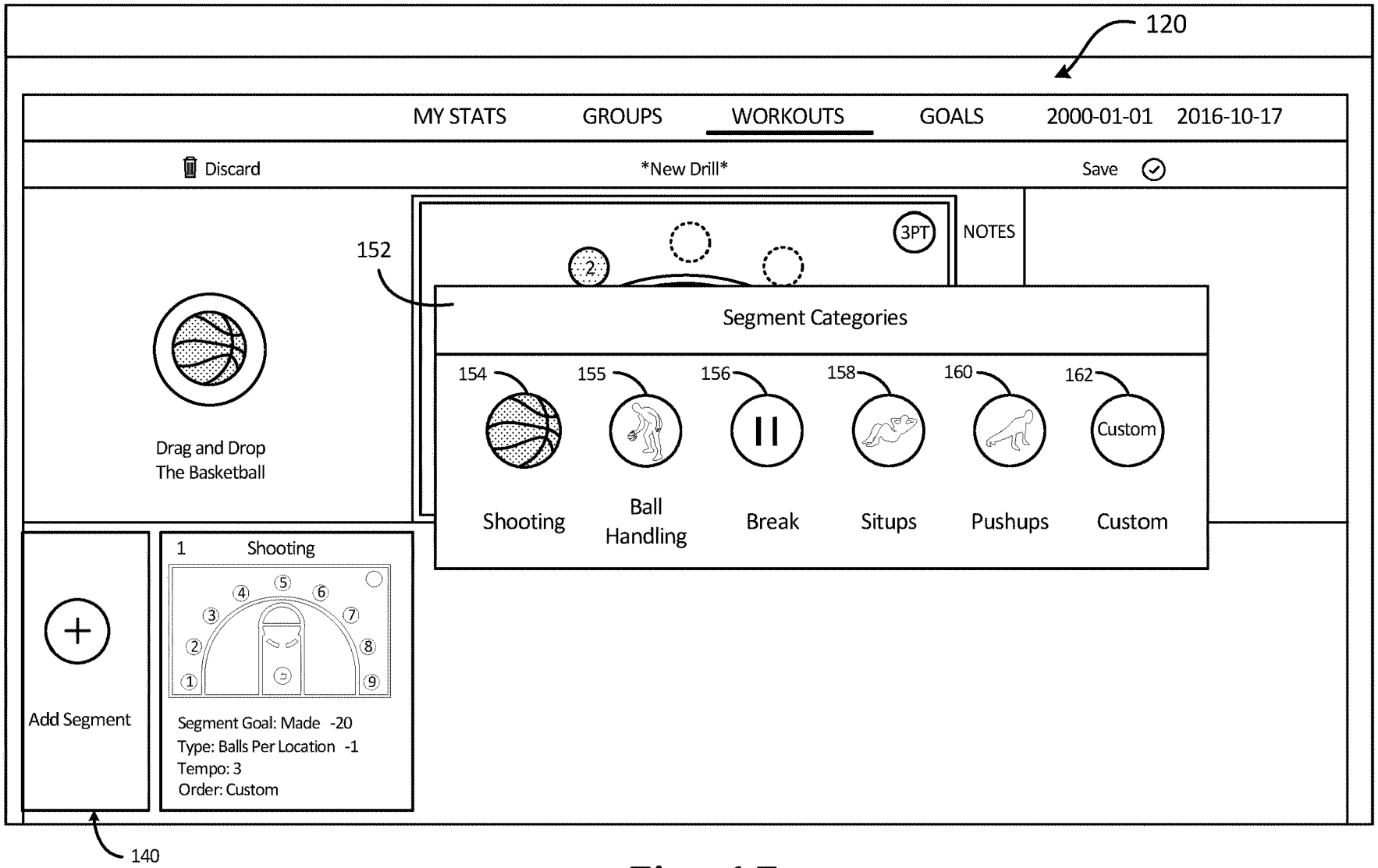

FIG. 15 is a screenshot of graphical user interface 120 after selection of segment addition icon 140. As illustrated in FIG. 15, in response to receiving user selection input of segment addition icon 140, workout module 100 causes graphical user interface 120 to present segment categories selection menu 152. Segment categories selection menu 152 includes shooting segment category icon 154, ball handling segment category 155, resting segment category icon 156, sit ups segment category icon 158, pushups segment category icon 160, and custom segment category icon 162. In response to receiving user selection input of shooting segment category icon 154, workout module 100 generates a next segment category as a shooting segment and presents graphical control elements to select the shooting segment parameters as described above. In response to receiving user selection input of ball handling segment category icon 155, workout module 100 generates a next segment category as a ball handling segment and presents graphical control elements to select a duration and type of the of the ball handling segment, such as a one-ball type, a two-ball type, a three-ball type, or other type of ball handling segment. In response to receiving user selection input of resting segment category icon 156, workout module 100 generates a next segment category as a resting (or break) segment and presents graphical control elements to select a duration of the resting segment. In response to receiving user selection input of sit ups segment category icon 158, workout module 100 generates a next segment category as a sit ups segment and presents graphical control elements to select one of a duration or number of sit ups. In response to receiving user selection input of pushups category icon 160, workout module 100 generates a next segment category as a pushups segment and presents graphical control elements to select one of a duration or number of pushups. In response to receiving user selection input of custom segment category icon 162, workout module 100 generates a next segment category as a custom category and presents graphical control elements to provide a description and/or name of the custom segment category as well as a time duration of the custom category.

Figure 16:
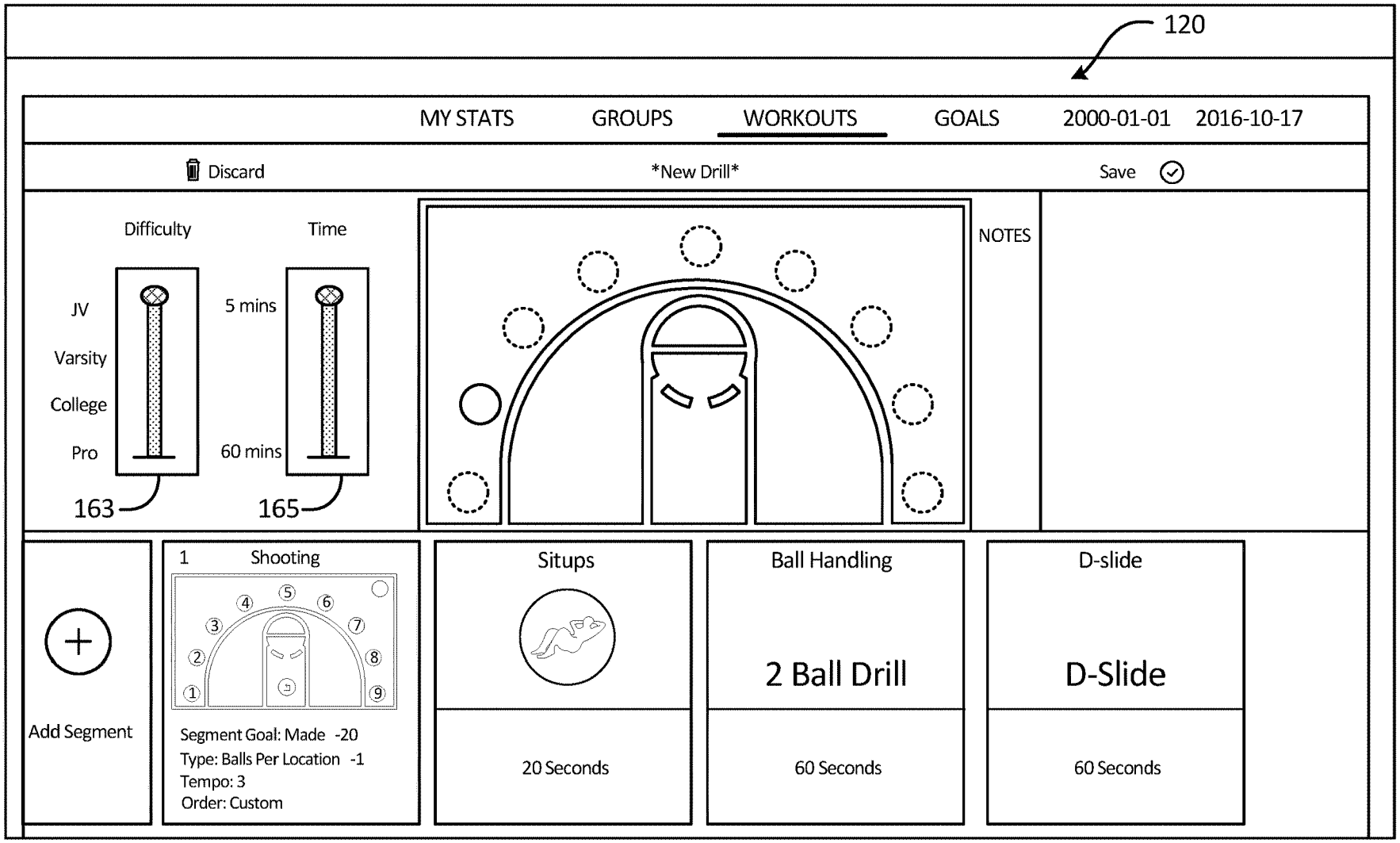

FIG. 16 is a screenshot of graphical user interface 120 after receiving user selection input of sit ups segment category icon 158, ball handling segment category icon 155, and custom segment category icon 162. That is, in the example of FIG. 16, workout module 100 first received user selection input of sit ups segment category icon 158 as well as user input to select a time duration of twenty seconds for the sit ups segment category. Further, in the example of FIG. 16, workout module 100 next received user selection input of ball handling segment category icon 155 as well as user input to select a two-ball segment type and a duration of sixty seconds, and last received user selection input of custom segment category icon 162 as well as user input to name the custom category "D-Slide" (i.e., corresponding to a defensive slide maneuver to increase both endurance and agility) and provide a time duration of sixty seconds for the custom "D-Slide" category.

As further illustrated in FIG. 16, graphical user interface 120 presents difficulty scaling control element 163 and time duration scaling control element 165. While difficulty scaling control element 163 and time duration scaling control element 165 are illustrated and described as graphical slider elements, in other examples, any one or more of difficulty scaling control element 163 and time duration scaling control element 165 can be presented as graphical buttons, graphical checkboxes, or other graphical control elements that enable a coach, player, or other user to select a modified difficulty (or skill) level.

Difficulty scaling control element 163 enables user input to efficiently modify a workout program based on a selected difficulty (or skill level) selected at difficulty scaling control element 163. For instance, a workout program stored at workouts 108 of database 104 can include workout program attributes that designate the workout program as corresponding to one of a plurality of difficulty levels (or player skill levels). Difficulty scaling control element 163 enables user input to select one of a plurality of difficulty (or skill) levels, such as the illustrated levels of junior varsity (JV) level, varsity level, collegiate level, or professional level. Though illustrated as including four separate difficulty levels, difficulty scaling control element 163 can present more or fewer than four difficulty levels. In certain examples, difficulty scaling control element 163 can enable selection of discrete difficulty levels, such as one of the four illustrated difficulty levels. In other examples, difficulty scaling control element 163 can enable selection of a difficulty level along an analog scale ranging from a least difficult level (e.g., JV) to a most difficult level (e.g., professional). In such examples, difficulty scaling control element 163 can enable selection of difficulty levels between the indicated discrete levels, such as between the JV and varsity levels, between the varsity and college levels, or between the college and professional levels, thereby enabling a greater number of level selections and a correspondingly greater flexibility in modifying workout programs.

In response to receiving an indication of a selected difficulty level via difficulty scaling control element 163, workout module 100 modifies the selected workout program, such as by modifying a number of total shots, a number of shots each selected ball delivery location, a ball delivery tempo (i.e., relative timing between delivery of balls to selected ball delivery locations), a position of ball delivery locations and/or selected shot locations, a number and/or intensity of exercises included in the workout program, or other modifications to the selected workout program to correspond to the selected difficulty level. Increasing the selected difficulty level, for example, can automatically increase the ball delivery tempo (i.e., decrease the time duration between consecutive ball deliveries), increase a total number of a made shots goal, increase a total number of a consecutive made shots goal, adjust ball delivery locations and/or selected shot locations to increase a distance of the locations from the basketball goal, adjust a distance of three-point shot locations, or other modifications. Similarly, decreasing the selected difficulty level can automatically modify parameters of the workout program to decrease the difficulty of the workout program. Accordingly, workout module 100 can automatically modify any one or more attributes of a workout program responsive to user input received via difficulty scaling control element 163 to modify the difficulty (or skill) level of a selected workout program without requiring user inputs to modify each of the individual workout attributes. In this way, workout module 100 utilizing difficulty scaling control element 163 can enable efficient adjustment of entire workout programs via a single user selection input at difficulty scaling control element 163.

As further illustrated in FIG. 16, graphical user interface 120 presents time duration scaling control element 165. Time duration scaling control element 165 enables user input to efficiently modify a duration of a workout program based on a time duration selected at time duration scaling control element 165. That is, time duration scaling control element enables a coach, player, or other user to maintain the format of a workout program (i.e., the selected ball delivery locations, player activities, goals, or other aspects of the workout program) but to modify the workout program to adhere to a modified time duration. For instance, a particular workout program can have a base time duration of, e.g., thirty minutes. In such an example, time duration scaling control element 165 enables the user to increase or decrease the time duration of the workout program from the base time duration of thirty minutes. Workout module 100, in response to receiving user input to increase the time duration of the workout program, can automatically increase a number of balls delivered to each ball delivery location, increase a time duration or number of exercise activities included in the workout program, increase a shots made or other goal of the workout program, or otherwise modify the workout program to increase the time duration of the workout program. Similarly, in response to receiving user input to decrease the time duration of the workout program, workout module 100 can automatically decrease any one or more activities of the workout program to automatically decrease the time duration of the workout program. As such, workout module 100 can automatically increase or decrease parameters of activities (e.g., segments) within a workout program in response to user input to select a modified time duration of the workout program without requiring the user (e.g., player, coach, or other user) to manually modify any one or more individual parameters of the workout program segments.

Figure 17:
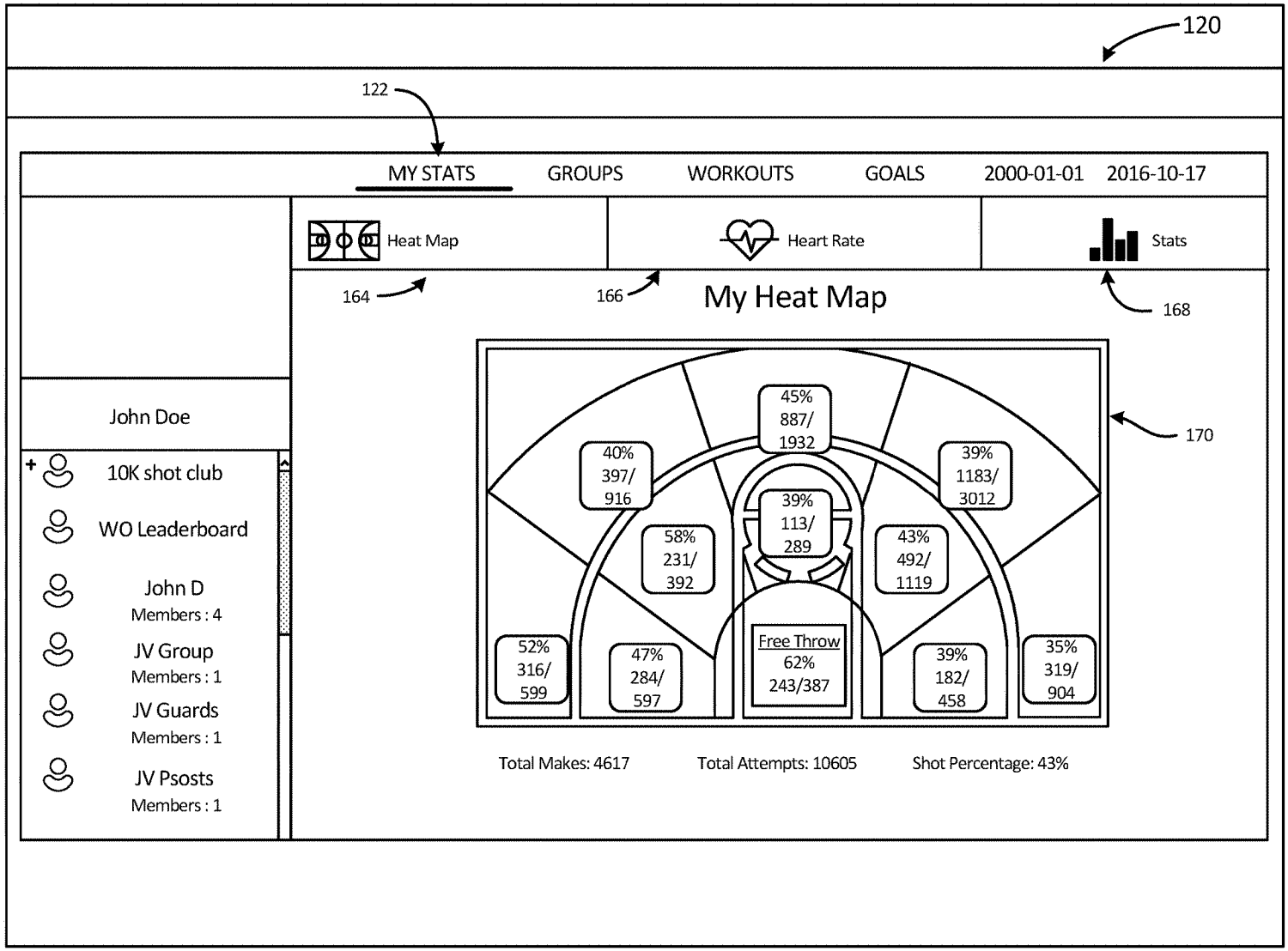

FIG. 17 is a screenshot of graphical user interface 120 in response to user selection input of My Stats contents tab 122. As further illustrated in FIG. 17, graphical user interface 120 presents heat map content tab 164, heart rate content tab 166, and statistics content tab 168 in response to user selection input of My Stats contents tab 122. FIG. 17 is a screenshot of graphical user interface 120 when heat map content tab 164 is selected.

As illustrated in FIG. 17, in response to user selection input to select heat map content tab 164, graphical user interface 120 presents heat map 170. Heat map 170 graphically renders a plurality of shot sectors with respect to a graphical representation of a portion of a basketball court. Shot sectors of heat map 170, illustrated by radial lines and arcs, correspond to non-overlapping sectors of the basketball court within which workout module 100 groups attempted and made shots at the basketball goal. Heat map 170 further presents statistical information in the form of shooting percentage, a number of attempted shots, and a number of made shots within each of the shot sectors and as an aggregate of all of the shot sectors. Statistical information presented at heat map 170 is derived from analytics data stored at analytics 110 of database 104 aggregated during execution of one or more workout programs at basketball training machine 10. Shot sectors of heat map 170 can be color coded to identify a range of performance (e.g., shooting percentage, number of shots made, or other performance) within each of the shot sectors. For instance, shot sectors corresponding to a shooting percentage that is greater than or equal to a highest threshold shooting percentage can be color coded green, shot sectors corresponding to a shooting percentage that is less than a lowest threshold shooting percentage can be color coded red, and shot sectors corresponding to a shooting percentage that is between the highest threshold shooting percentage and the lowest threshold shooting percentage can be color coded yellow.

Figure 18:
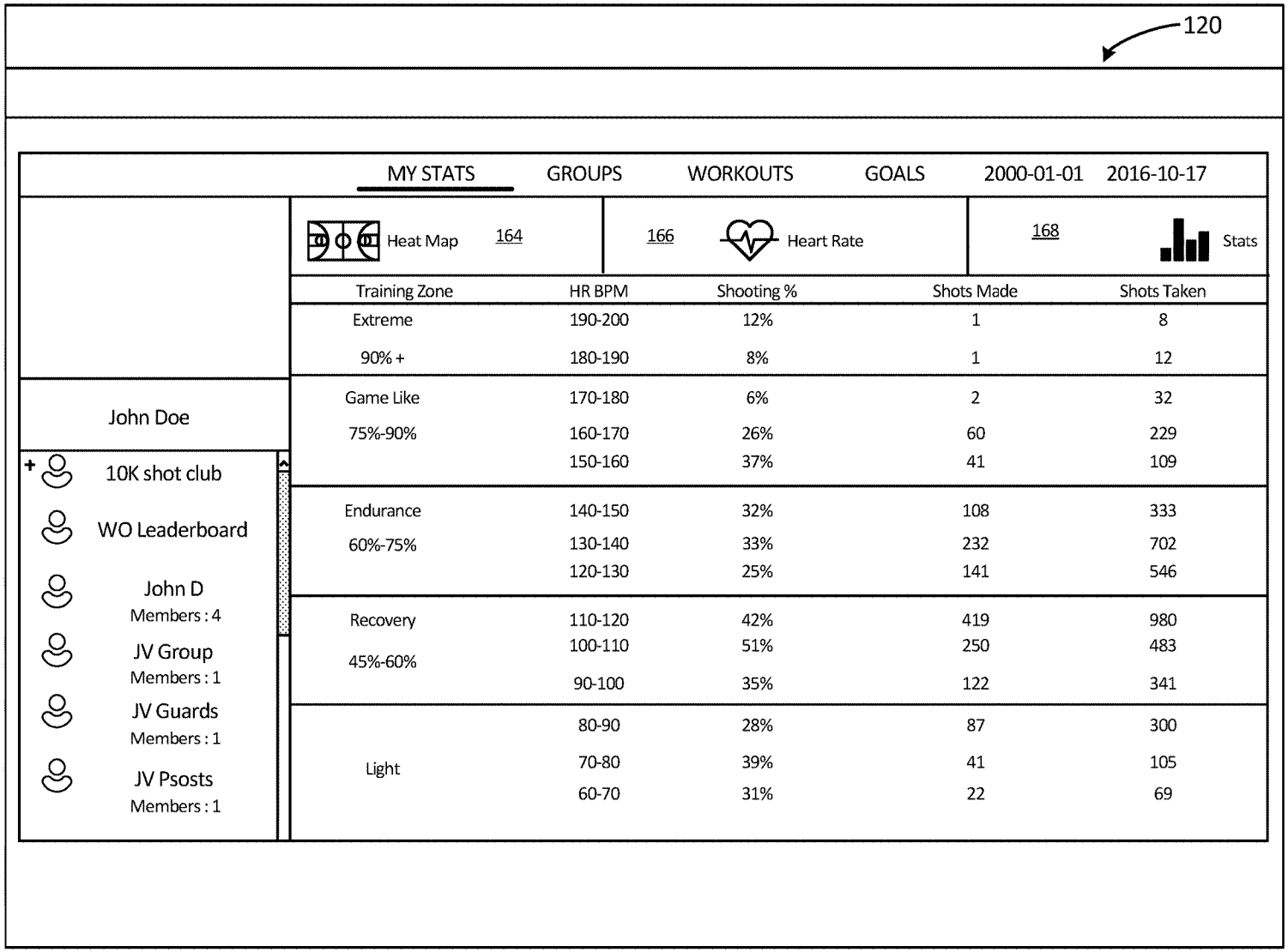

FIG. 18 is a screenshot of graphical user interface 120 in response to user selection input of heart rate content tab 166. As illustrated in FIG. 18, in response to user selection input of heart rate content tab 166, graphical user interface 120 presents statistical data corresponding to shooting percentage, a number of made shots, and a number of attempted shots for each of a plurality of heart rate ranges. As illustrated, graphical user interface 120 can categorize the heart rate ranges, in descending order of heart rate, as one of an extreme (e.g., high) heart rate range, a game-like heart rate range typically encountered by players during basketball games, an endurance heart rate range, a recovery heart rate range, and a light heart rate range.

Figure 19:
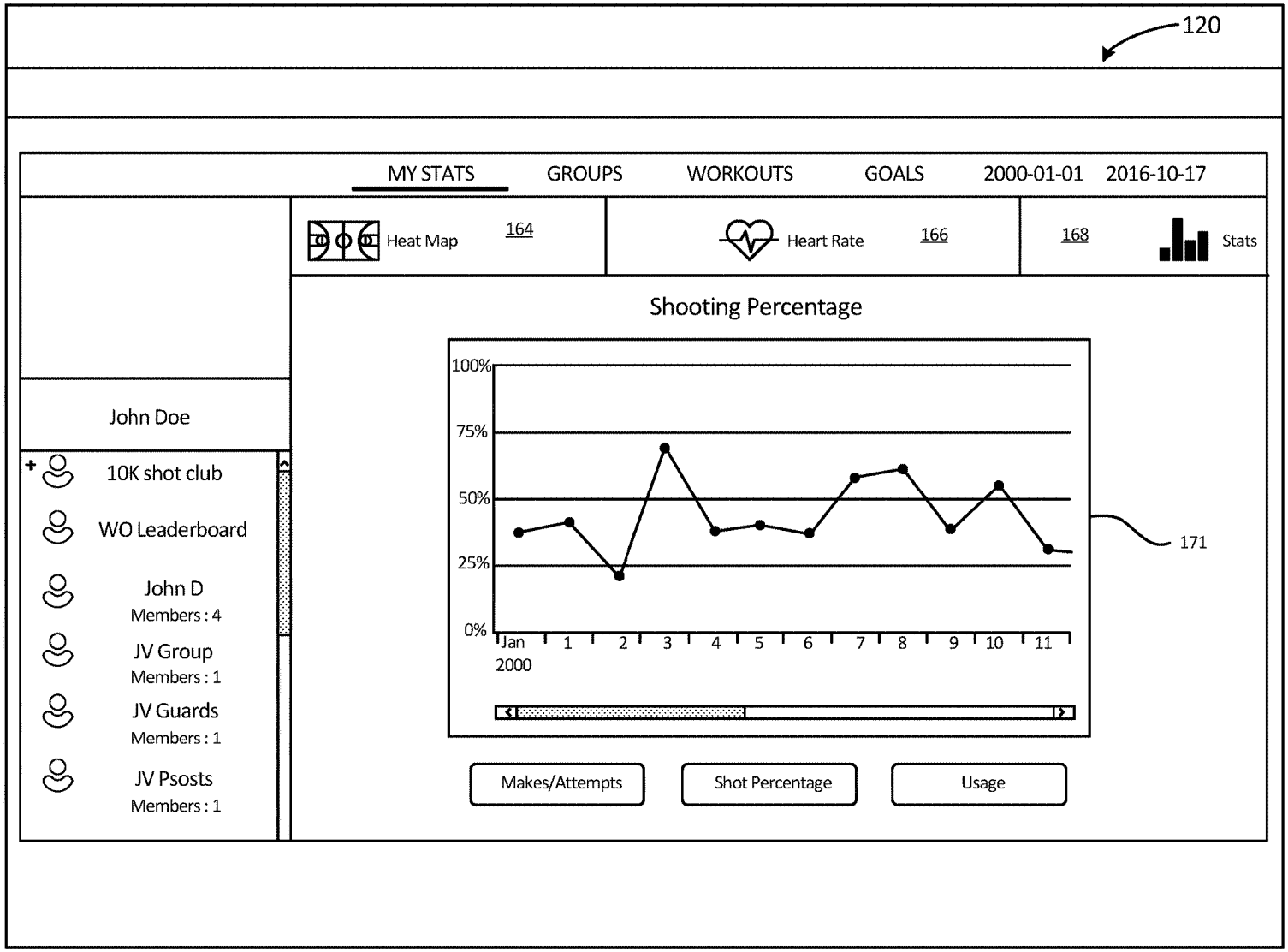

FIG. 19 is a screenshot of graphical user interface 120 in response to user selection input of statistics content tab 168. As further illustrated in FIG. 19, in response to user selection input of statistics content tab 168, graphical user interface 120 presents shooting percentage graph 171 that displays shooting percentage corresponding to a user account with respect to time. In addition, graphical user interface 120 displays graphical control elements (e.g., buttons in this example) that enable user selection input to display statistical information corresponding to a number of made shots and a number of attempted shots as well as usage information of basketball training machine 10 (e.g., a number of shots taken, a total time used, or other usage information).

Figure 20:
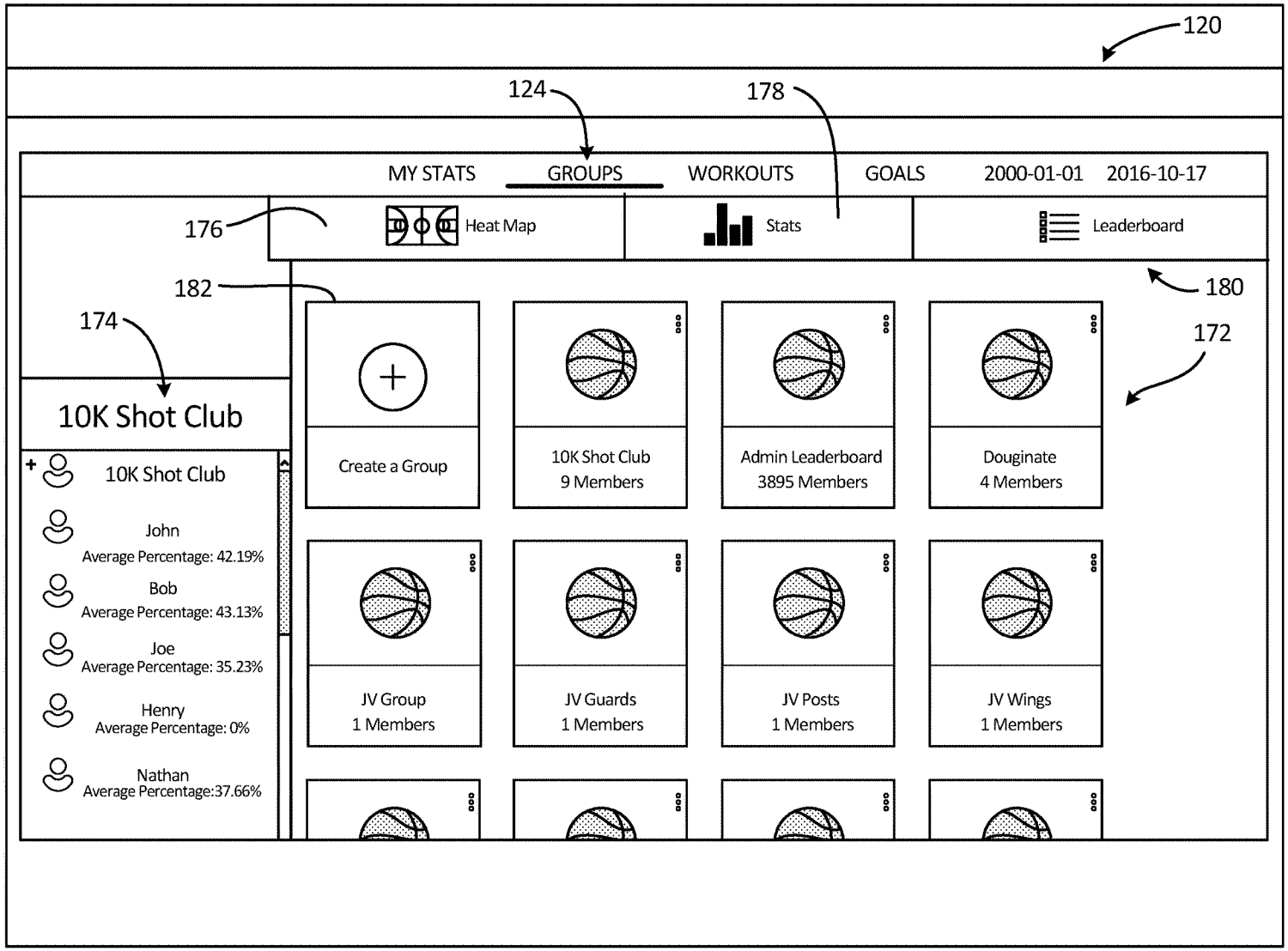

FIG. 20 is a screenshot of graphical user interface 120 in response to user selection input of Groups contents tab 124. As illustrated in FIG. 20, in response to user selection input of Groups contents tab 124, graphical user interface 120 presents group selection region 172, group member region 174, heat map content tab 176, statistics content tab 178, and leaderboard content tab 180. Group selection region 172 includes group addition icon 182.

Group selection region 172, as illustrated in FIG. 20, presents a plurality of selectable icons corresponding to group accounts stored at accounts 106 of database 104. Each of the selectable icons corresponding to the group accounts presents an indication of a number of member accounts associated with the group account and is user selectable to identify the group account as a selected group account. Graphical user interface 120 presents indications of the selected group account and each member account included within the selected group account at group member region 174. Each indication of the selected group account and the individual member accounts presented at group member region 174 is user selectable to cause graphical user interface 120 to display parameters for the selected account corresponding to a selected one of heat map content tab 176 and statistics content tab 178, as is further described below. In response to user selection input of group addition icon 182, workout module 100 causes graphical user interface 120 to present graphical control elements to enable user input to create a group account and associate one or more member accounts with the created group account.

Figure 21:
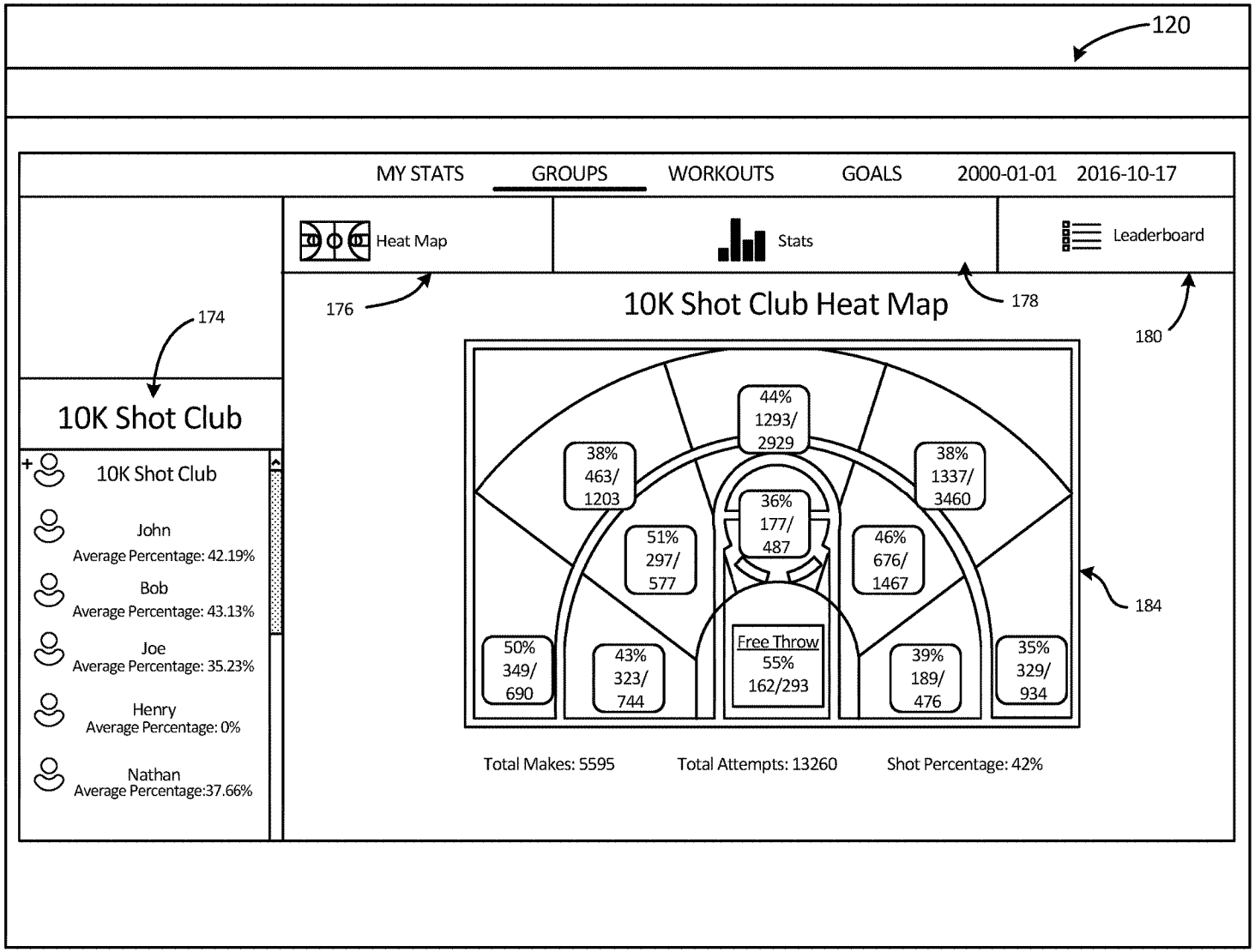

FIG. 21 is a screenshot of graphical user interface 120 in response to user selection input of heat map content tab 176. As illustrated, in response to user selection input of heat map content tab 176, graphical user interface 120 displays heat map 184. Heat map 184 graphically renders a plurality of shot sectors with respect to a graphical representation of a portion of a basketball court. Heat map 184 displays statistical information for the selected group account or a selected member account of the selected group account (i.e., selected in group member region 174) in the form of shooting percentage, a number of attempted shots, and a number of made shots within each of the shot sectors and for an aggregate of all of the shot sectors. That is, in the example of FIG. 21, group member region 174 displays the selected group account entitled "10K shot club" (i.e., corresponding to ten thousand shots) as well as the member accounts associated with the selected 10K shot club. In the example of FIG. 21, heat map 184 displays statistical information for the selected 10K shot club group account, though in other examples, heat map 184 displays statistical information for a selected member account of the selected 10K shot club group account in response to receiving user selection input of the member account at group member region 174.

Figure 22:
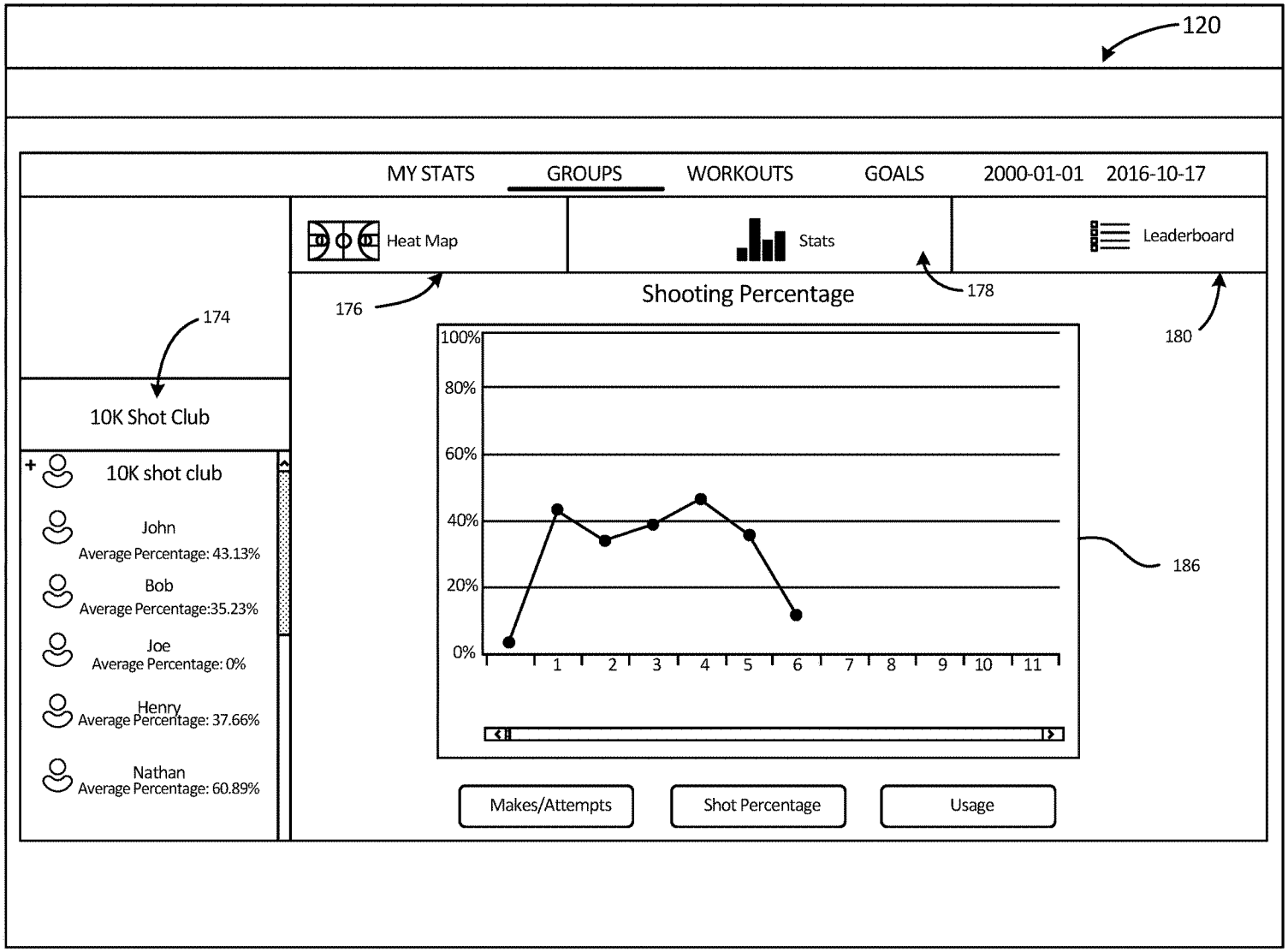

FIG. 22 is a screenshot of graphical user interface 120 in response to user selection input of statistics content tab 178. As illustrated in FIG. 22, in response to user selection input of statistics content tab 178, graphical user interface 120 displays shooting percentage graph 186 that displays shooting percentage data with respect to time for the selected group account or a selected member account of the selected group account. In the example of FIG. 22, shooting percentage graph 186 displays shooting percentage data with respect to time for the selected 10K shot club group account, though in other examples, shooting percentage graph 186 displays shooting percentage data for a selected member account of the selected 10K shot club group account in response to receiving user selection input of the member account at group member region 174. In addition, graphical user interface 120 displays graphical control elements (e.g., buttons in this example) that enable user selection input to display statistical information corresponding to a number of made shots and a number of attempted shots as well as usage information of basketball training machine 10 (e.g., a number of shots taken, a total time used, or other usage information) for the selected group account or a selected member account of the selected group account.

Figure 23:
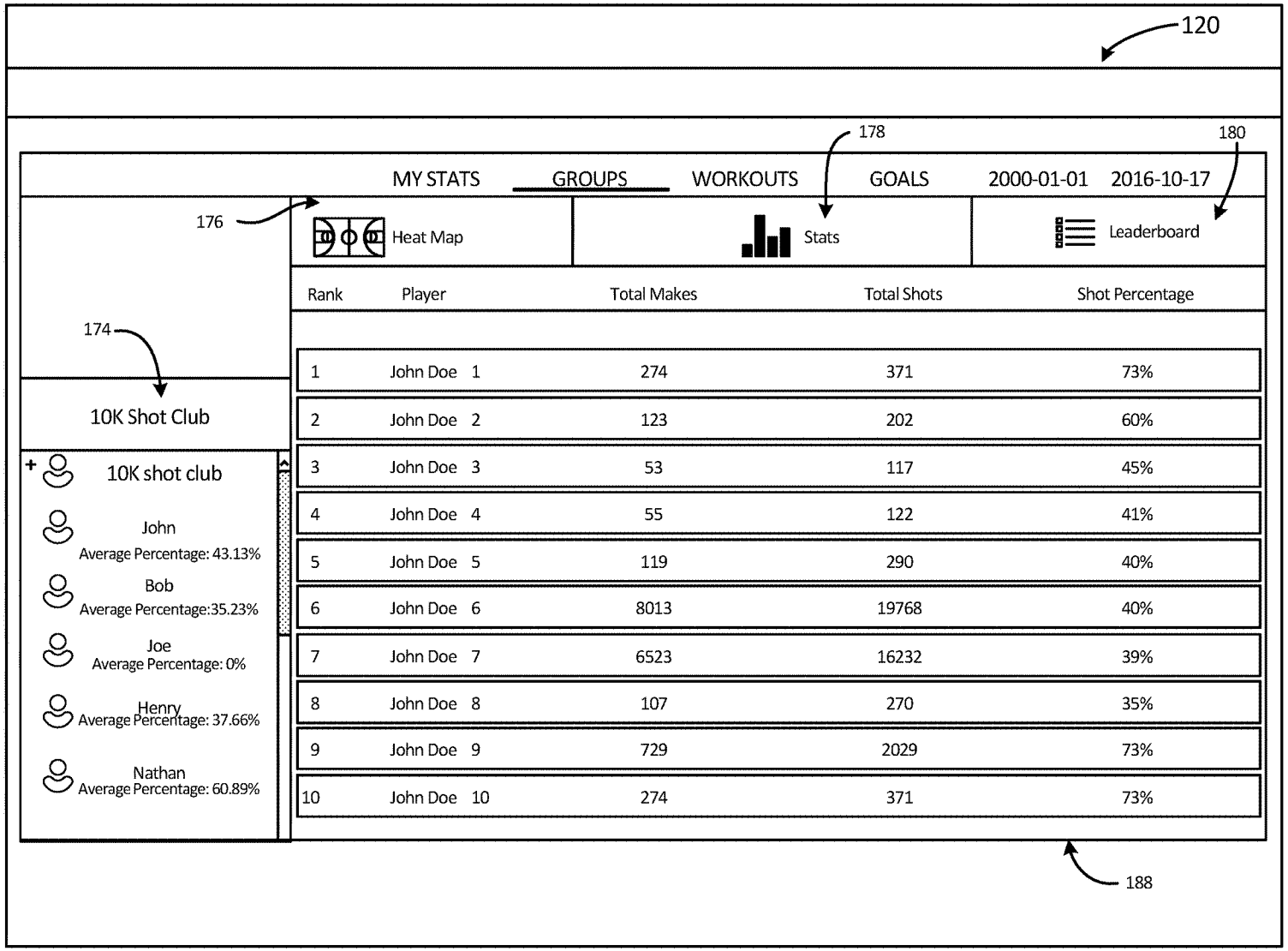

FIG. 23 is a screenshot of graphical user interface 120 in response to user selection input of leaderboard content tab 180. As illustrated in FIG. 23, in response to user selection input of leaderboard content tab 180, graphical user interface 120 presents leaderboard 188. Leaderboard 188 displays statistical data corresponding to user accounts and user account groups in the form of a total number of made shots, a total number of attempted shots, and a shooting percentage for each of the user accounts and user account groups. Leaderboard 188 displays the statistical data and names of user accounts and account groups in descending order as sorted by one of the total number of made shots, the total number of attempted shots, and the shooting percentage (e.g., in response to user selection input specifying the sorting column). Accordingly, leaderboard 188 enables users to view a ranking of multiple user accounts and account groups stored at database 104.

Figure 24:
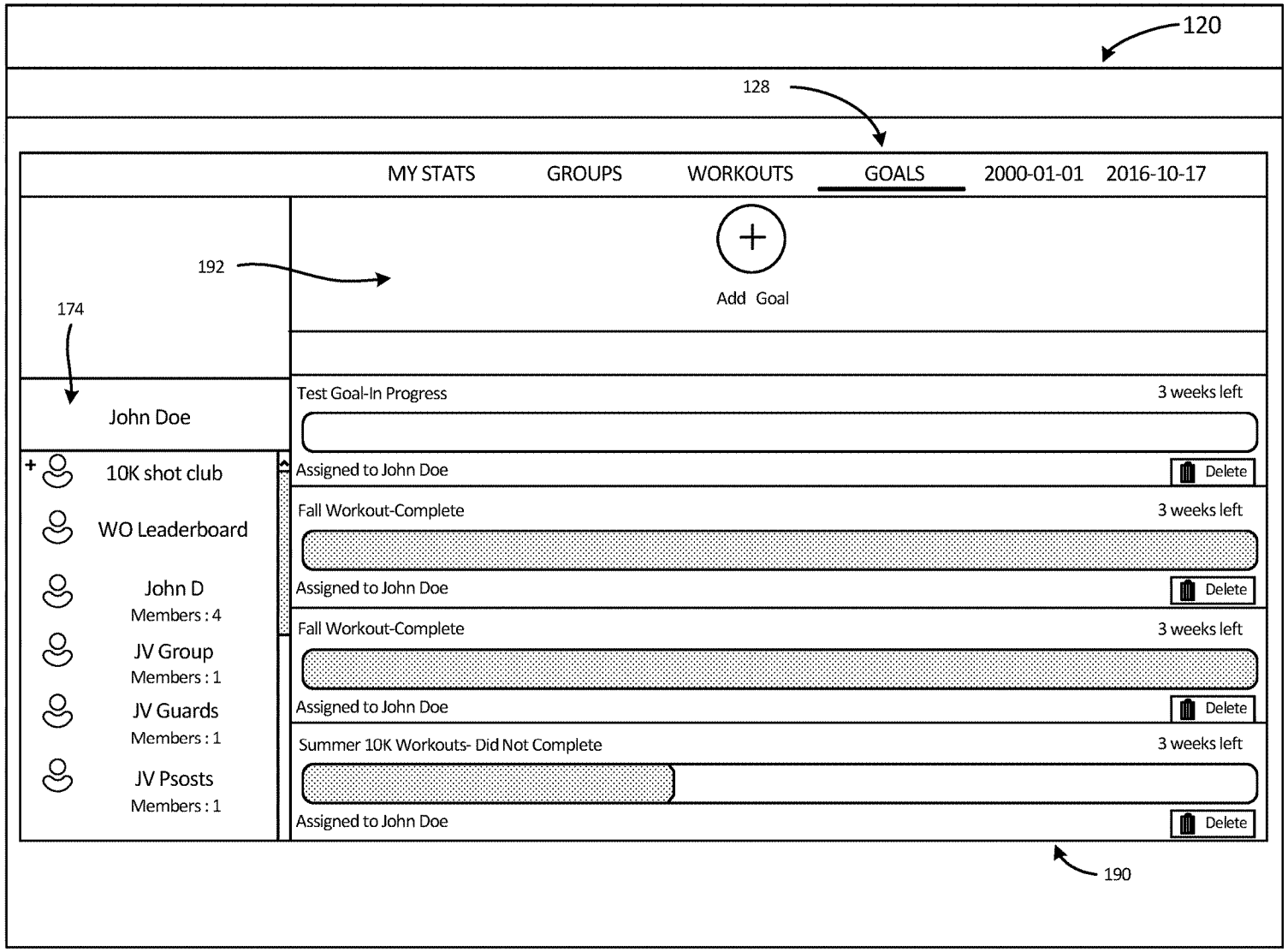

FIG. 24 is a screenshot of graphical user interface 120 in response to user selection input of Goals contents tab 128. As illustrated in FIG. 24, in response to receiving user selection input of Goals contents tab 128, graphical user interface 120 presents goals presentation region 190, which includes goal addition icon 192. Goals presentation region 190 displays one or more goals associated with a selected group account or a selected member account of the selected group account (i.e., as selected at group member region 174). Individual goals are displayed with a description of the goal, an indication of the group account or member account to which the goal is assigned, a progress bar displaying a current progress toward completion of the goal, an indication of a duration of time until completion of the goal is due, and an indication of whether the goal is in progress, completed, or was not completed prior to the date at which the goal was due. Goal addition icon 192 enables user selection input to assign a new goal to the selected account group of member account. In response to user selection input of goal addition icon 192, graphical user interface presents graphical control elements to enable user input corresponding to a description (or name) of the goal, a type of goal (e.g., a number of made shots, a number of attempted shots, or other types of goals), and a time (e.g., date) at which completion of the goal is due.

Accordingly, graphical user interface 120 managed by workout module 100 and accessible via website 102 or other software application (e.g., app) accessing server 98 enables user interaction input to define workout programs that can significantly improve both skills training and endurance training via basketball training machine 10 to better prepare players for game-like situations. Graphical user interface 120 can be accessed directly via an interface of basketball training machine 10 or via any one or more computing devices having a communicative connection with server 98, thereby increasing flexibility and accessibility in generating workout programs and analyzing corresponding workout results.

While the examples of FIGS. 11-24 have been described with respect to graphical user interface 120 presenting candidate locations for selection of desired ball delivery locations, aspects of this disclosure are not so limited. That is, techniques described herein to generate workout programs including selected ball delivery locations are well suited to examples in which graphical user interface 120 presents a visual representation of a basketball court that is free of indicia representing predetermined (or candidate) ball delivery locations and enables user input to select ball delivery locations that are not limited in location by such predetermined locations. The examples of FIGS. 25, 26, 27A, and 27B describe example operations of basketball training system 96 in which graphical user interface 120 enables greater flexibility in selecting both ball delivery locations and the location of basketball training machine 10.

Figure 25:
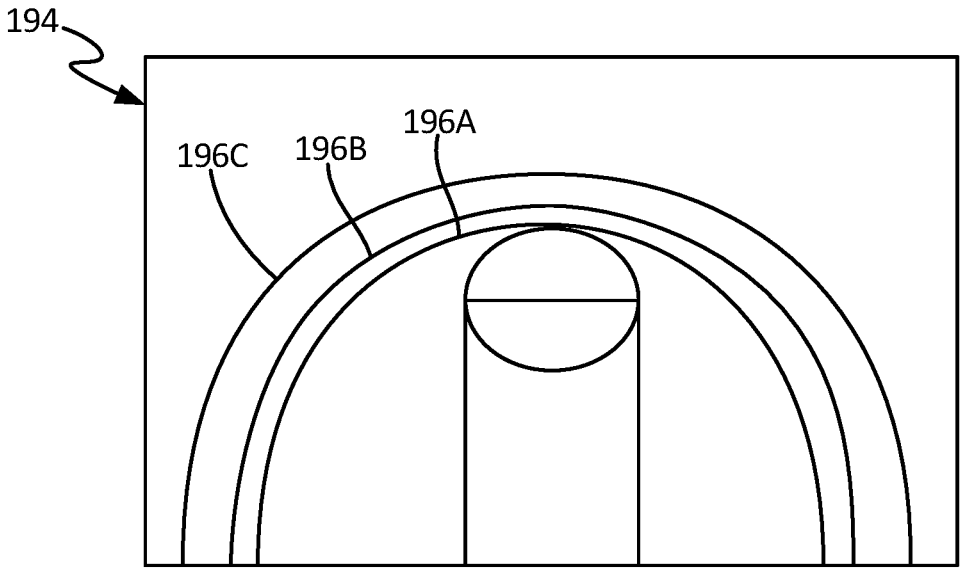
FIG. 25 is a conceptual diagram illustrating a portion of the graphical user interface that presents a visual representation of a portion of a basketball court that is free of indicia representing predetermined ball delivery locations.
Figure 26:
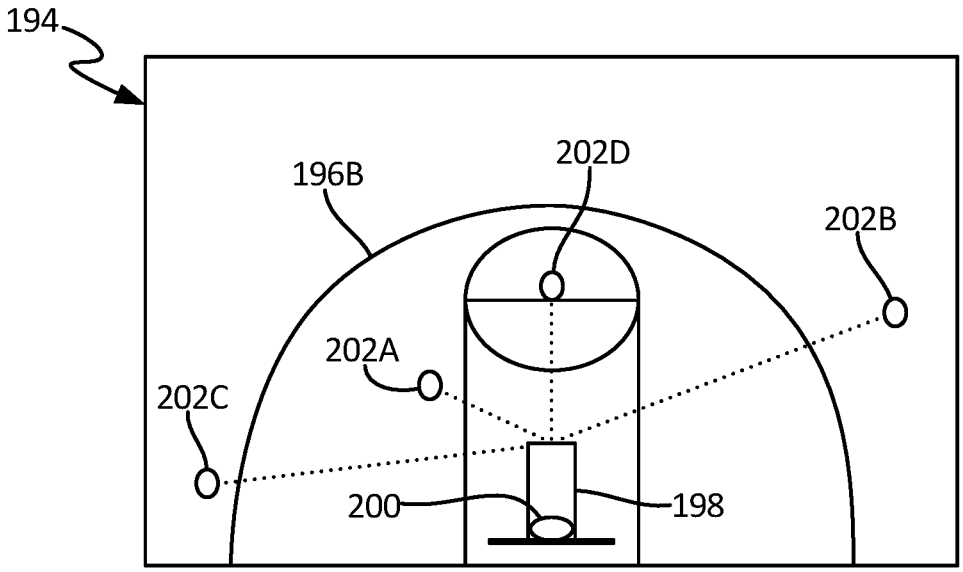
FIG. 26 is a conceptual diagram illustrating the portion of the graphical user interface displaying selected ball delivery locations with a graphical icon corresponding to the basketball training machine located beneath a basketball goal.
Figure 27A:
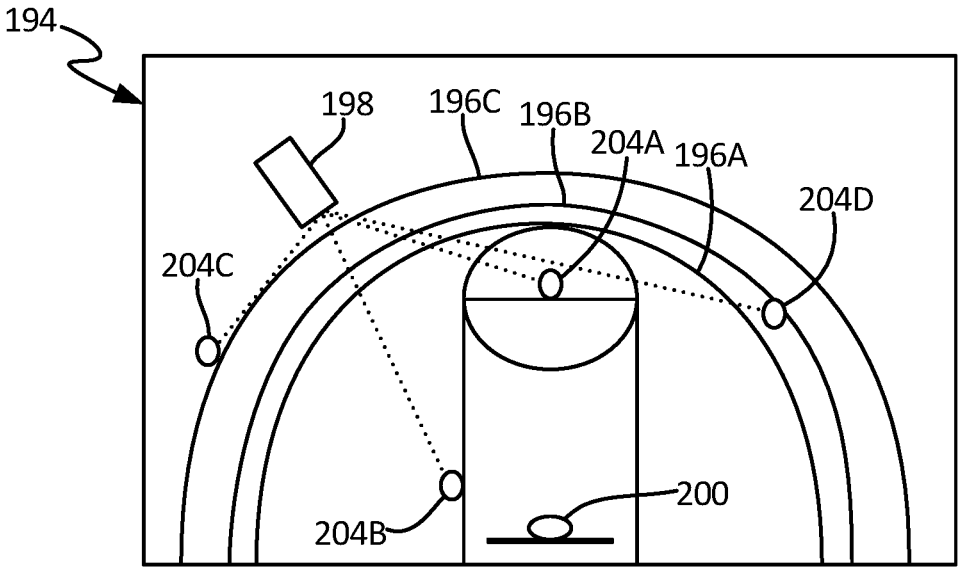
FIG. 27A illustrates a first orientation of the portion of the graphical user interface corresponding to a first viewer perspective of the portion of the basketball court from a location nearest to beneath the basketball goal.
Figure 27B:
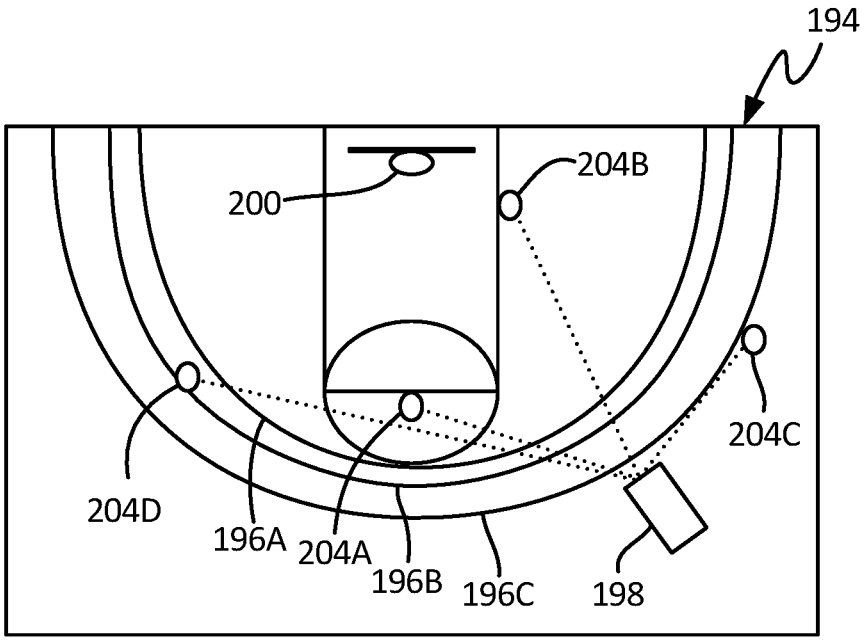
FIG. 27B illustrates a second orientation of the portion of the graphical user interface corresponding to a second viewer perspective of the portion of the basketball court from a location nearest to mid court.

FIG. 25 is a conceptual diagram illustrating portion 194 of graphical user interface 120 that presents a visual representation of a portion of a basketball court that is free of indicia representing predetermined ball delivery locations. FIG. 26 is a conceptual diagram illustrating portion 194 of graphical user interface 120 displaying selected ball delivery locations 202A-202D with graphical icon 198 corresponding to basketball training machine 10 located underneath a basketball goal. FIGS. 27A and 27B illustrate differing orientations of portion 194 of graphical user interface 120 displaying selected ball delivery locations 204A-204D on the visual representation of the portion of the basketball court. That is, FIG. 27A illustrates a first orientation of portion 194 corresponding to a first viewer perspective of the portion of the basketball court from a location nearest to beneath the basketball goal. FIG. 27B illustrates a second (opposite) orientation of portion 194 corresponding to a second viewer perspective of the portion of the basketball court from a location nearest to mid court. For purposes of clarity and ease of discussion, the examples of FIGS. 25, 26, 27A, and 27B are described below within the context of basketball training system 96 of FIGS. 5-10. While described below as outputting a visual representation of a portion of a basketball court having line markings corresponding to a standard North American basketball court, it should be understood that graphical user interface 120 can output a visual representation of other types of basketball courts (e.g., having line markings corresponding to standard European courts) or other playing surfaces (e.g., volleyball court, soccer field, or other types of playing surface).

As illustrated in FIG. 25, workout module 100 causes graphical user interface 120 to output portion 194 that presents a visual representation of a portion of a basketball court including three-point lines 196A, 196B, and 196C. Portion 194, as illustrated in FIG. 25, is free of indicia representing predetermined ball delivery locations, such as graphically-rendered or other visual markings, graphically-rendered or physical buttons, lights, or other physical or graphically-rendered indications representing predetermined ball delivery (or shot) locations. Accordingly, as is further described below, portion 194 of graphical user interface 120 enables user interaction via gesture or other input (e.g., mouse, keyboard, voice command, or other user interaction input) relative to the visual representation of the portion of the basketball court to identify selected ball delivery locations without limiting such locations via predetermined indicia of location.

Three-point lines 196A, 196B, and 196C each represent boundaries on the visual representation of the portion of the basketball court separating two-point regions (between the basketball goal and the respective three-point line) from three-point regions (outside the interior of the respective three-point arc). Each of three-point lines 196A, 196B, and 196C represent three-point boundary lines traditionally used in high school competitions and younger (i.e., three-point line 196A), collegiate competitions (i.e., three-point line 196B), and professional competitions (i.e., three-point line 196C), though other three-point boundary lines or indications of point value bifurcations are possible.

Graphical presentation of any one or more of three-point lines 196A, 196B, and 196C can be user selectable via graphical user interface 120. For instance, graphical user interface 120 can present one or more graphical control elements, such as checkboxes, dropdown menus, buttons, sliders, or other graphical control elements configured to allow user input to select the graphical rendering of any combination of three-point lines 196A, 196B, and 196C on the visual representation of the portion of the basketball court (including the graphical rendering of none of three-point lines 196A, 196B, and 196C). As an example, graphical user interface 120 can present graphical control elements in the form of three checkboxes, each corresponding to one of three-point lines 196A, 196B, and 196C and having a selectable attribute to cause graphical user interface 120 to display the corresponding one of three-point lines 196A, 196B, and 196C. As illustrated in FIG. 25, graphical user interface 120 presents each of three-point lines 196A, 196B, and 196C on the visual representation of the portion of the basketball court, though any combination (or none) of three-point lines 196A, 196B, and 196C can be displayed.

Graphical user interface 120 and/or basketball training machine 10 utilize three-point lines 196A, 196B, and 196C to determine a point value corresponding to a made shot associated with a ball delivery location, as is further described below. In certain examples, graphical user interface 120 presents graphical control elements that enable user interaction to identify which of three-point lines 196A, 196B, and 196C is selected as bifurcating the three-point region from the two-point region for purposes of point value. For instance, graphical user interface 120 can present graphical control elements enabling user interaction to select the display of each of three-point lines 196A, 196B, and 196C, and to utilize, e.g., three-point line 196B as the active three-point line for purposes of allocating shot values. Accordingly, graphical user interface 120 can enable user interaction to cause portion 194 of graphical user interface 120 to display any one or more of three-point lines 196A, 196B, and 196C and to utilize a selected one of three-point lines 196A, 196B, and 196C for purposes of shot value allocation.

In the illustrated example of FIG. 26, portion 194 of graphical user interface 120 displays selected ball delivery locations 202A, 202B, 202C, and 202D on the visual representation of the portion of the basketball court. In addition, portion 194 illustrates graphical icon 198 corresponding to basketball training machine 10 located beneath a basketball goal. Graphical icon 200, corresponding to shots made sensor 26, is displayed at a location corresponding to placement of shots made sensor 26 immediately below the basketball goal. In the example of FIG. 26, portion 194 displays three-point line 196B without displaying three point lines 196A and 196C (e.g., corresponding to user input selection to display and/or utilize three-point line 196B for shot value allocations).

Dotted lines extending from icon 198 illustrate delivery of balls from basketball training machine 10 to each of ball delivery locations 202A-202D, though the dotted lines may not be graphically rendered by portion 194 of graphical user interface 120 in some examples. In addition, it should be understood that, in operation, basketball training machine 10 rotates to deliver balls to each of ball delivery locations 202A-202D.

The group of ball delivery locations 202A-202D represents an ordered sequence of selected ball delivery locations. The ordered sequence can be user selectable and modifiable. For instance, the ordered sequence can correspond to user selection to deliver one or more basketballs first to ball delivery location 202A, second to ball delivery location 202B, third to ball delivery location 202C, and fourth to ball deliver location 202D. In general, the ordered sequence can correspond to any ordered sequence of ball delivery locations 202A-202D that can be selected by user input to identify the sequence. In some examples, the ordered sequence can include movement of icon 198 corresponding to ball delivery machine 32 (and the associated movement of ball delivery machine 32) between locations on portion 194 of graphical user interface 120, such as between locations underneath the basketball and away from the basketball goal, between locations away from the basketball goal, or other movements of icon 198. While illustrated as including four selected ball delivery locations 202A-202D, in other examples, more or fewer than four ball delivery locations can be selected.

In operation, workout module 100 causes server 98 to output an indication of the locations and sequence of selected ball delivery locations 202A-202D to basketball training machine 10 (i.e., to controller 94 via communication device 84), which delivers basketballs to the selected locations according to the ordered sequence. The indication of the locations can include, e.g., an indication of relative angles between each of selected ball delivery locations 202A-202D. In some examples, the indication of the locations can include a position of selected ball delivery locations 202A-202D with respect to the visual representation of the portion of the basketball court. In other examples, the indication of the locations can include a position of selected ball delivery locations 202A-202D with respect to the basketball court after scaling of the locations from a graphical scale (corresponding to the visual representation) to a physical scale (corresponding to the physical basketball court).

In some examples, workout module 100 can receive indications of the selected ball delivery locations in the form of a stored workout program stored at, e.g., workouts 108 of database 104. For instance, graphical user interface 120 can present graphical control elements that enable user input (e.g., gesture input, mouse input, keyboard input, voice command input, or other user input) to select the stored workout program. In response, workout module 100 can retrieve the stored workout program information from workouts 108 of database 104. The stored workout program can indicate the selected ball delivery locations, the sequence of the selected ball locations, tempo information corresponding to timing of the delivery of basketballs between the selected ball delivery locations, a number of basketballs to be delivered to each of the selected ball delivery locations, or other information corresponding to the stored workout program. In some examples, the stored workout program can indicate a location and/or orientation of ball delivery machine 10, as is further described below.

Workout module 100 can receive indications of selected ball delivery locations 202A-202D via user selection input relative to the visual representation of the portion of the basketball court. For example, user selection input can include gesture input (e.g., tap gesture input, drag-and-drop gesture input, or other gesture input) relative to the visual representation of the portion of the basketball court received at a touchscreen display. In some examples, user selection input can include location selection input relative to the visual representation of the portion of the basketball court received via a mouse, keyboard, or other input device.

In certain examples, workout module 100 can receive (and cause graphical user interface 120 to display) indications of selected user shot locations independent from the indications of selected ball delivery locations. For instance, workout module 100 can receive indications of user selection input (e.g., tap gesture input, drag-and-drop gesture input, mouse input, keyboard input, or other user selection input) to select user shot locations corresponding to a selected ball delivery location. The selected user shot locations can indicate locations relative to the visual representation of the portion of the basketball court corresponding to a shot location that is different than a selected ball delivery location. The selected shot locations can correspond to user movement prior to receiving the basketball at a selected ball delivery location, after receiving the basketball at the selected ball delivery location, or both. For example, a user can receive a basketball at a selected ball delivery location and move (e.g., dribble) to the selected shot location corresponding to the selected ball delivery location to attempt the shot at the basketball goal. In other examples, the user can receive the basketball at the selected ball delivery location after specified player movement (e.g., specified and displayed via graphical user interface 120) and can attempt the shot at the basketball goal from at or near the selected ball delivery location. In yet other examples, the user can receive the basketball at the selected ball delivery location after specified first movement and can attempt the shot at the basketball goal at a separate selected shot location after specified second movement from the selected ball delivery location. Workout module 100 and/or controller 94 of basketball training machine 10 can utilize selected user shot locations, rather than the selected ball delivery locations, for purposes of shot value allocations in examples where the selected shot location is specified as separate from the selected ball delivery location.

The ability to specify selected shot locations independent from selected ball delivery locations enables workout module 100 and/or controller 94 to attribute shot values and, in some examples, determine user analytics corresponding to the selected shot locations rather than merely the selected ball delivery locations. Such differentiation between selected shot locations and selected ball locations enables balls to be delivered to locations that are, e.g., in the three-point range (i.e., outside the selected three-point line) and to allocate shot values according to a selected shot location that is, e.g., in the two-point range (i.e., inside the selected three-point line). Similarly, balls can be delivered to locations within the two-point range while having a corresponding shot location that is within the three-point range, thereby enabling simulation of game-like user movement while allocating shot values (and tracking user analytics data) corresponding to the actual shot location that can be different than the selected ball delivery location. Moreover, the ability to incorporate user movement before and/or after receiving the basketball at the selected ball delivery location enables enhanced workout program development that better simulates the game-like movement encountered by players in games, rather than requiring that shots be attempted from at or near the ball delivery location for purposes of shot value allocation and user analytics data (e.g., analytics corresponding to user shooting percentage from a location, while moving in a particular direction, from a particular side of the court, from a particular range on the court, or other analytics).

In some examples, portion 194 of graphical user interface 120 can display an indication of the selected player movement between selected ball delivery locations and corresponding selected user shot locations. For instance, portion 194 of graphical user interface 120 can display an arrowed line, a dotted or dashed line, a shaded or colored curvilinear path, an animated path, or other graphical indication of the selected player movements. Indications of the selected ball delivery locations and the selected user shot locations can be differentiated by, e.g., a color of the indication, a shading of the indication, a shape of the indication, or other differentiations. In certain examples, controller 94 can coordinate operation of projection system 83 to project an indication of selected ball delivery locations and/or selected user shot locations on the physical basketball court. For example, controller 94 can control operation of projection system 83 to project an optical indication (e.g., a spot of light) corresponding to a next selected ball delivery location, thereby providing visual guidance to the user of a next location to which balls will be delivered. As another example, controller 94 can control operation of projection system 83 to project a first optical indication (e.g., a first spot of light) corresponding to a selected ball delivery location and a second optical indication corresponding to a selected user shot location. The first and second optical indications can be simultaneously displayed and visually differentiable via, e.g., color, size, shape, or other differentiations. For instance, controller 94 can cause projection system 83 to output a red spot of light at a selected ball delivery location and a green spot of light at a selected user shot location corresponding to the selected ball delivery location, thereby providing visual guidance to a user regarding the location of a next ball delivery as well as a shot location to which the user is to move to attempt the shot. In yet other examples, controller 94 can cause a speaker or other audio system to output an audible indication of a next ball delivery location and/or selected user shot location (e.g., the audible words "left post", "right free-throw elbow", or other audible indications). Accordingly, controller 94 can coordinate operation of ball delivery machine 32 to guide a user through a workout program including multiple ball delivery and shot locations from various locations of the court.

In certain examples, graphical user interface 120 can present graphical control elements that enable user input to select one or more player maneuvers associated with selected player movement between selected ball delivery locations and corresponding selected user shot locations. Examples of selected player maneuvers can include pump fakes, jab steps, crossover dribbles, behind the back dribbles, two dribble pullups, three dribble pullups, or other player maneuvers to be performed prior to or simultaneously with player movement between a selected ball delivery location and a corresponding selected user shot location. Portion 194 of graphical user interface 120 can display an indication of the selected player maneuvers, such as by displaying textual descriptions of the maneuvers, graphical icons representing the maneuvers, animations of the maneuvers, or other indications of the selected player maneuvers.

The ordered sequence of selected ball delivery locations 202A-202D can be determined, in some examples, according to a sequence by which user selection input is received to select ball delivery locations 202A-202D. For instance, a user can select ball delivery locations 202A-202D in the ordered sequence by first selecting ball delivery location 202A, second selecting ball delivery location 202B, third selecting ball delivery location 202C, and fourth selecting ball delivery location 202D. In some examples, graphical user interface 120 can present graphical control elements in the form of numbered icons that can be controlled via, e.g., drag-and-drop gesture input to identify the ordered sequence of selected ball delivery locations. For instance, a user can provide gesture input to move the numbered icons (e.g., via drag-and-drop gesture input) to locations relative to the visual representation of the portion of the basketball court to identify both the order and location of selected ball delivery locations (e.g., by moving a first numbered icon to a first ball delivery location corresponding to a first location in the ordered sequence, moving a second numbered icon to a second ball delivery location corresponding to a second location in the ordered sequence, etc.) In some examples, the user can provide gesture input to move the numbered icons to previously-selected ball delivery locations to identify the ordered sequence of the selected ball delivery locations.

In certain examples, graphical user interface 120 can provide one or more graphical control elements that enable user input to reorder the ordered sequence of selected ball delivery locations 202A-202D. For example, graphical user interface 120 can provide graphical control elements that enable user input to move a selected ball delivery location to a particular position in the ordered sequence (e.g., first, second, third, fourth, etc.) In some examples, graphical user interface 120 can provide graphical control elements that enable user input to move a selected ball delivery location relative to a current position of the selected ball delivery location within the ordered sequence (e.g., forward or backward a selected number of places within the ordered sequence). In some examples, graphical user interface 120 can provide graphical control elements that enable user input to delete and/or insert one or more selected ball delivery locations within the ordered sequence of selected ball delivery locations 202A-202D.

Workout module 100 can cause graphical user interface 120 to output an indication of the ordered sequence of selected ball delivery locations 202A-202D at portion 194. For example, workout module 100 can cause graphical user interface 120 to output a numerical value corresponding to the ordered sequence at each of selected ball delivery locations 202A-202D (e.g., the number 1 at or near ball delivery location 202A, the number 2 at or near ball delivery location 202B, the number 3 at or near ball delivery location 202C, and the number 4 at or near ball delivery location 202D). In certain examples, basketball training machine 10 outputs an indication of a location of a next selected ball delivery location to which a basketball is to be delivered, such as at front display 46 or via a wired or wireless speaker of basketball training machine 10.

Graphical user interface 120 can provide one or more graphical control elements that enable user input (e.g., gesture input, mouse input, keyboard input, or other user input) to select a number of basketballs to be delivered to each of selected ball delivery locations 202A-202D, a tempo (or relative timing) between delivered basketballs, a shots made goal, a time duration goal, a shots attempted goal, a consecutive shots made goal, a total number of points made goal, or other goal associated any one or more of selected ball delivery locations 202A-202D (i.e., to be met before basketballs are delivered to a sequentially next one of selected ball delivery locations 202A-202D), or other information corresponding to selected ball delivery locations 202A-202D.

Accordingly, graphical user interface 120 (including portion 194) enables user interaction to select ball delivery locations relative to the visual representation of the portion of the basketball court to identify selected ball delivery locations that are not limited in location by indicia of predetermined shot locations. As such, basketball training system 96 implementing graphical user interface 120 can enable user input to more effectively simulate the level of movement required of the shooter and the variety of shot locations frequently encountered in game conditions to enhance the training experience. Moreover, graphical user interface 120 and corresponding operation of basketball training system 96 described herein enables a user to attempt shots from both two-point and three-point ranges (and associated shot value allocations to be tracked), to attempt shots both before and after specified player movement, and to receive varying types of passes (e.g., bounce passes, chest passes, lob passes, or other types of passes) at varying ball delivery speeds that can be designated by the user and/or automatically determined by controller 94 based on a distance between ball delivery machine 32 and selected ball delivery locations. The techniques can therefore provide a dramatically enhanced training experience (as compared to a system that limits ball delivery locations to predefined locations and ball delivery speeds to a single, or manually selected speed) that better simulates game-like scenarios and accommodates workout programs that can be specifically targeted to a player's developmental needs.

FIGS. 27A and 27B illustrate differing orientations of portion 194 of graphical user interface 120 displaying selected ball delivery locations 204A, 204B, 204C, and 204D on the visual representation of the portion of the basketball court. That is, FIG. 27A illustrates a first orientation of portion 194 corresponding to a first viewer perspective of the portion of the basketball court from a location nearest to beneath the basketball goal. FIG. 27B illustrates a second (opposite) orientation of portion 194 corresponding to a second viewer perspective of the portion of the basketball court from a location nearest to mid court. The displayed orientation of portion 194 can be selectable (e.g., via graphical control elements presented by graphical user interface 120) to enable user selection based on which orientation is easier for the user to understand. In certain examples, more than two display orientations of portion 194 can be presented for user selection, such as an orientation corresponding to a user perspective from a right side of the court, an orientation corresponding to a user perspective from a left side of the court, or other display orientations.

As further illustrated in FIGS. 27A and 27B, portion 194 illustrates graphical icon 198 corresponding to basketball training machine 10 located away from the basketball goal. In some examples, basketball training machine 10 can be positioned on the basketball court away from the basketball goal without ball collection system 12 (i.e., including only ball delivery system 14). In such examples, a non-shooting user can feed ball delivery system 14 with additional basketballs to enable workout programs requiring more basketballs than can be held within main ball feeder 34 of ball delivery system 14. In other examples, basketball training machine 10 can be positioned on the basketball court away from the basketball goal with ball collection system 12 attached, such that the shooting user can rebound shots and deliver (e.g., throw) them to ball collection system 12 for collection and resupply to ball delivery system 14.

As further illustrated in FIG. 27A, portion 194 of graphical user interface 120 displays graphical icon 200 corresponding to shots made sensor 26 (which can be wirelessly connected with basketball training machine 10) at a location corresponding to placement of shots made sensor 26 immediately below the basketball goal. Portion 194, in this example, displays each of three-point lines 196A, 196B, and 196C, though user input can be received to select one of three-point lines 196A-196C as an active three-point line for purposes of shot value allocation by controller 94 of basketball training machine 10.

Graphical icon 198, in the example of FIG. 27A, illustrates a location and orientation of basketball training machine 10 when positioned away from the basketball goal. In some examples, graphical icon 198 can be user selectable to adjust (i.e., modify) the orientation of icon 198 to match an orientation of basketball training machine 10 on the basketball court. In such examples, a user can rotate icon 198 with respect to the visual representation of the portion of the basketball court to match the orientation of basketball training machine 10 as it is physically oriented on the basketball court, or can physically rotate basketball training machine on the basketball court to match the orientation of icon 198 relative to the visual representation of the portion of the basketball court. In other examples, icon 198 can be preset to orient in a predetermined direction or toward a predetermined location of the visual representation of the portion of the basketball court. For instance, icon 198 can be preset to orient toward the basketball goal as user input is received to modify the location of icon 198 relative to the visual representation of the portion of the basketball court. In such examples, a user can physically orient basketball training machine 10 in the predetermined direction or toward the predetermined location (e.g., basketball goal) of the basketball court.

Workout module 100, in some examples, causes server 98 to transmit an indication of the orientation and location of icon 198 to basketball training machine 10, which utilizes the location and orientation information to coordinate operation of components of basketball training machine 10 to deliver basketballs to selected ball delivery locations 204A-204D. In other examples, workout module 100 causes server 98 to transmit to basketball training machine 10 position information of selected ball delivery locations 204A-204D relative to icon 198. In such examples, basketball training machine 10 can deliver basketballs to selected ball delivery locations 204A-204D based on the relative position information without knowledge of absolute position of icon 198 with respect to the visual representation of the portion of the basketball court. As such, rather than require a user to mentally translate the location and orientation of icon 198 relative to predetermined ball delivery locations when basketball training machine 10 is located away from the basketball goal, basketball training system 96 implementing techniques described herein can enable a user to select ball delivery locations relative to a graphically-rendered icon having an orientation and location corresponding to a physical location and orientation of basketball training machine 10. That is, the ability to place icon 198 on portion 194 relative to the visual representation of the portion of the basketball court such that icon 198 matches both a location and orientation of ball delivery machine 32 on the physical basketball court enables a user to more easily select ball delivery locations, user shot locations, or provide other input relative to icon 198 without requiring the user to mentally invert or transpose the orientation of icon 198 to match the position of ball delivery machine 32 as would be required if icon 198 could only be graphically rendered, e.g., under the basketball goal.

The techniques described herein enable a user (e.g., player, coach, administrator, training expert, or other user) to select desired ball delivery locations relative to a visual representation of a basketball court that are not limited by indications of predetermined ball delivery locations. Basketball training machine 10 can adjust a ball delivery speed and/or trajectory of delivered balls to automatically adjust for varying distances between basketball training machine 10 and selected ball delivery locations, as well as differing types and/or elevations of passes at any one or more of the ball delivery locations. Moreover, the ability to position basketball training machine 10 away from the basketball goal and to easily select ball delivery locations (and, in some instances, separate user shot locations), specify player movement, player maneuvers, and identify goals associated with such locations can enable the user to better simulate game-like conditions where passes are most frequently received from a location other than beneath the basketball goal. This ability to better simulate game-like player movement as well as pass delivery and receipt locations at varying locations and distances from the basketball goal without limiting such locations via predefined indicia can increase an effectiveness of the time spent training to prepare the user to effectively respond to game-like conditions.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A system for tracking off of the dribble shooting statistics, said system comprising:

an ejector configured to launch basketballs to pass receipt locations spaced apart about a basketball playing area;

an interface configured to receive a user selected sequence of passes comprising a subset of said pass receipt locations where said user desires to receive basketball passes at and a user selection of off of the dribble shooting information comprising an indication of shooting attempts associated with certain of said pass receipt locations in said subset where said user intends to perform a pre-shooting basketball move immediately before or after receiving a basketball pass from said ejector, wherein at least said user selected sequence of passes and said user selection of off the dribble shooting information defines, at least in part, a custom basketball practice arrangement;

a detector configured to detect made basketball shots during performance of said custom basketball practice arrangement; and a controller configured to:

receive data from said interface representing said user selected sequence of passes and said off of the dribble shooting information;

command said ejector to launch at least one basketball to each of said pass receipt locations in said subset;

receive data from said detector indicating made basketball shots; and associate certain of the data received from said detector corresponding to said certain of said pass receipt locations with an indication of an off of the dribble shooting attempt.

2. The system of claim 1 wherein:

said pre-shooting basketball move includes movements simulating game conditions; and said pre-shooting basketball move excludes purely exercise-related movements.

3. The system of claim 1 wherein:

said controller is further configured to generate a performance report comprising feedback for each of said pass receipt locations in said subset and a qualifier associated with at least some of said feedback indicating said off of the dribble shooting attempts.

4. The system of claim 3 wherein:

said interface is provided on a personal electronic device; and said controller is configured to transmit said performance report to said personal electronic device for display.

5. The system of claim 3 wherein:

said interface comprises an electronic display physically connected to said ejector; and said controller is configured to transmit said performance report to said electronic display for display.

6. The system of claim 3 wherein:

said interface is configured to generate a visual depiction of at least a portion of a regulation basketball court and representations of said pass receipt locations at locations on said visual depiction visually correspondent with the pass receipt locations at said playing area.

7. The system of claim 6 wherein:

said interface comprises a touch screen configured to receive said user input in a direct, physical manner.

8. The system of claim 6 wherein:

each of said pass receipt locations are displayed prior to selection by said user.

9. The system of claim 6 wherein:

said visual depiction comprises a rendering of a three-point line; and said representations comprise markers spaced apart along the three-point line.

10. The system of claim 6 wherein:

said performance report comprises a second visual depiction of at least said portion of said regulation basketball court; and said feedback comprises an indication of made shots for each of said pass receipt locations in said subset displayed at locations on said second visual depiction visually correspondent with the pass receipt locations at said playing area in said subset.

11. The system of claim 10 wherein:

said indication is provided as a percentage of made basketball shots.

12. The system of claim 3 wherein:

said performance report comprises a ranking of players in a group.

13. The system of claim 12 wherein:

said players are ranked by percentage of successfully made basketballs shots.

14. The system of claim 1 wherein:

said interface is configured to display travel path information for certain of said pass receipt locations in said subset in accordance with said off of the dribble shooting information received.

15. The system of claim 1 further comprising:

a frame extending between said ejector and said interface.

* * * * *